US006594927B2

(12) United States Patent
Witkowski

(10) Patent No.: US 6,594,927 B2
(45) Date of Patent: Jul. 22, 2003

(54) LABEL OR WRAPPER WITH PREMIUM

(75) Inventor: Daniel D. Witkowski, Plymouth, MN (US)

(73) Assignee: MagicCom, Minneapolis, MN (US)

( * ) Notice: Subject to any disclaimer, the term of this patent is extended or adjusted under 35 U.S.C. 154(b) by 0 days.

(21) Appl. No.: 08/949,236

(22) Filed: Oct. 10, 1997

(65) Prior Publication Data

US 2003/0056410 A1 Mar. 27, 2003

Related U.S. Application Data

(63) Continuation-in-part of application No. 08/518,746, filed on Aug. 24, 1995, now Pat. No. 5,676,401.
(60) Provisional application No. 60/039,328, filed on Mar. 17, 1997.

(51) Int. Cl.[7] ..... G09F 3/00
(52) U.S. Cl. ..... 40/310; 40/306
(58) Field of Search ..... 40/306, 310; 283/81, 283/94, 101

(56) References Cited

U.S. PATENT DOCUMENTS

| | | | | |
|---|---|---|---|---|
| 1,054,826 A | | 3/1913 | Cole | |
| 1,145,367 A | | 7/1915 | Herter | |
| 1,756,944 A | | 5/1930 | Gorton, Jr. | |
| 1,974,401 A | | 9/1934 | Miller | |
| 1,982,282 A | | 11/1934 | Bock | 273/138 |
| 2,093,985 A | | 9/1937 | Stansbury | |
| 2,167,305 A | | 7/1939 | Kropp | |
| 2,254,545 A | | 9/1941 | Roberts | |
| 3,524,782 A | | 8/1970 | Buske | |
| 3,638,340 A | | 2/1972 | Gottschalk | |
| 3,704,892 A | | 12/1972 | Moravick et al. | |
| 3,835,564 A | | 9/1974 | Gottschalk | 40/306 |
| 3,914,483 A | | 10/1975 | Stipek, Jr. | |
| 3,994,089 A | | 11/1976 | Schwartz | 40/310 |
| RE29,127 E | * | 2/1977 | Janssen | 40/373 |
| 4,308,679 A | | 1/1982 | Ray, III et al. | 40/312 |
| 4,336,664 A | | 6/1982 | Penick et al. | 40/594 |
| 4,551,373 A | | 11/1985 | Conlon | 428/43 |

(List continued on next page.)

FOREIGN PATENT DOCUMENTS

| | | |
|---|---|---|
| EP | 0 283 064 | 9/1988 |
| GB | 2 226 297 | 6/1990 |

OTHER PUBLICATIONS

Exhibit A of return address stickers (attached to action).*
Exhibit B front of return address stickers (attached to action).*
Exhibit C back of return address stickers (attached to action).*
Colorcon Brochure, Entitled "Games, Novelties and other Promotional Items," 21 pgs., Feb. 1994.

*Primary Examiner*—William L. Miller
(74) *Attorney, Agent, or Firm*—James A. Geppert

(57) ABSTRACT

A novel method for the application of collectible or play premiums which are positioned on labels or wrappers for consumer packaging to provide value to the advertising label stock and provide an incentive for the initial and repeat purchase of the consumer product. The premiums may be in the form of stickers, transferable tattoos, painting or other activity members, glow-in-the-dark or scented inks, etc., which are integral with the labeling material such that the label has an essentially uniform thickness which will not create problems in the use of high-speed automated machinery that is utilized in the application of the label stock to the consumer product. The flexible label comprises a first layer having advertising thereon and a second layer coextensive with the first layer providing a uniform thickness and includes a removable premium which is separated from the label for play or collection by the user.

15 Claims, 11 Drawing Sheets

U.S. PATENT DOCUMENTS 4,621,442 A 11/1986 Mack
4,621,837 A 11/1986 Mack ..... 283/105
4,634,149 A 1/1987 Donovan ..... 283/102
4,648,548 A 3/1987 Shin
4,846,504 A 7/1989 MacGregor et al. ..... 283/102
4,913,858 A 4/1990 Miekka et al.
4,973,088 A 11/1990 Levy ..... 283/81
5,021,110 A 6/1991 Kobayashi
5,024,014 A * 6/1991 Swierczek ..... 40/310
5,207,458 A * 5/1993 Treichel et al. ..... 40/306 X
5,207,746 A * 5/1993 Jones ..... 40/306 X
5,234,735 A * 8/1993 Baker et al. ..... 40/306 X
5,380,045 A 1/1995 Comann ..... 283/70
5,413,384 A 5/1995 Principe et al. ..... 283/81
5,525,383 A 6/1996 Witkowski ..... 428/30
5,595,404 A * 1/1997 Skees ..... 283/116
5,676,401 A * 10/1997 Witkowski et al. ..... 283/81

* cited by examiner

LABEL OR WRAPPER WITH PREMIUM

This patent application is a continuation-in-part application of U.S. patent application Ser. No. 08/518,746, filed Aug. 24, 1995, now U.S. Pat. No. 5,676,401, and is a continuation-in-part of a provisional patent application entitled "Label or Wrapper With Premium" filed Mar. 17, 1997 and assigned provisional Ser. No. 60/039,328, which are both herein incorporated by reference.

FIELD OF THE INVENTION

The invention relates to novelty items added to consumer products including food or beverage containers, wrappers and other packaging.

BACKGROUND OF THE INVENTION

Cereal companies have employed toys or other premiums inside boxes or containers to stimulate consumer interest in their products. Rings, toys, books, comics and the like have been included in boxes or affixed to food containers to add value to the purchase of a particular cereal or snack. Producers of other products such as packaged goods and foodstuffs sold in cans, bottles, cones, tubes, rolls, tubs or other containers have found it difficult, expensive or otherwise impractical to add a "premium play element" or collectible value to their products because there has not been an efficient and cost effective method to consistently deliver the premium to the consumer without investing in other equipment to insert the premium into or onto a package.

Cereal boxes provide a large, dry environment for reception of a toy or other premiums, while cans, tubs, bottles and other containers do not allow for the insertion of premiums because of the potential contamination and safety hazards for consumers. To place an item on a package traditionally has necessitated additional packaging equipment that may not otherwise be available to the packager. The addition of this equipment often results in the reduction of production line speed and the reconfiguration of a manufacturing or packaging line adds time and expense to the product that increases the added up-front costs associated with including the premium in the food product. Premiums are therefore unlikely to be added or to be used by a variety of manufacturers.

The backs of labels have been used to deliver coupons or special messages for consumers but they have been limited to standard printing inks and paper, with no real play or collectible value for children or adults. For example, U.S. Pat. Nos. 1,054,826 and 1,756,944 disclose the use of labels on canned goods that includes information, such as recipes printed on the inside surface of the label. U.S. Pat. No. 4,634,149 discloses a label having a game of chance positioned on the back side of a label and U.S. Pat. No. 4,336,664 discloses the incorporation of a puzzle onto a label or packaging.

The addition of each type of unique play premium to packaging wrappers creates its own unique problems since the addition of pigments, or non-traditional inks or substrates and materials on the front or back surface of a wrapper can raise the premium above the surface of the wrapper material. Wrappers are generally dispensed from magazines or trays during assembly and/or loading and the automated incorporation of the food into a wrapper or a wrapper onto a container of food or beverage generally requires that the wrapper sit flat and provide an essentially uniform thickness throughout to avoid reconfiguration of the wrapper assembly and packaging and to maintain uniformity and accuracy in the process of adding the food to the wrapper or adding the wrapper to a food or beverage container.

A variety of children play toys, activities and novelty items are known, including, but not limited to, self adhesive or remoistable adhesive stickers, activity books with a number of activities such as paintable inks, such as inks paintable with water or other safe solvents, transfers, tattoos, scratch-off type hiding activities for adults or children, glow-in-the-dark pictures, "scratch and sniff" type activity books, and the like. Despite their attraction to children and adults, these types of activities are virtually impossible to efficiently deliver as a collectible premium on many consumer products because of their cost in manufacture, the need for additional equipment to facilitate the addition of the premium to a product and the rate at which the assembly process must normally be slowed to facilitate and verify premium placement and assembly.

Traditional label or wrapper application processes often employ heat. Depending on how the wrapper is applied, high temperatures can compromise a premium that is closely associated with a wrapper. Heat, for example, can cause both pressure sensitive and remoist adhesives to melt, migrate, burn or cause equipment to jam during the packaging process. The addition of premium stickers or other novelty items to packaging would generally require the reconfiguration of the packing or labeling equipment. This added cost becomes prohibitive since the costs cannot be passed readily to the consumer. Many pre-manufactured pressure sensitive or self adhesive materials are far more expensive than traditional wrapper or label paper and the added cost of these materials, in addition to the glues, special inks, die cutting, etc., in any quantity added to food packaging becomes economically prohibitive particularly because the assembly is often performed as separate independent manufacturing steps. In addition, the self adhesive or remoistable adhesive materials do not have the same application properties as labels comprising paper. Due to their stiffness and rigidity, they require expensive resins, solvents or hot glues for application. Pre-made pressure-sensitive materials, especially films, may also conduct static electricity. Moreover, the premade films tend to curl when cut and placed in a tray or magazine thereby making it undesirable for automated labeling schemes. In addition, the stickers may be affected by the heat or cold of the cans, packages or containers as they exit the manufacturing line off of a cooker, bottling equipment, wrapper, or the like.

Stickers, for example, have been used as a play device by children for many years and they have been popular as a collectable item in many forms including a variety of stamps, reward by teachers and parents, as games, as trading items between children and to incorporate the stickers into a picture in a book or on a poster. Methods for producing multiple ply labels are known and methods for manufacturing multiple labels are disclosed in U.S. Pat. No. 1,756,944 to Gordon. This type of paper has little intrinsic value as a play piece or as a collectible item to a child or adult or as a value added item on products.

Preferred collectible stickers and other premiums must be positioned with accuracy on the label surface to fit within the confines of the overall wrapper. For example, a large area for stickers, taking up 25% or more of the label, needs to be repeatably positioned relative to the edges of the label to facilitate automation. U.S. Pat. No. 1,756,944 to Gordon does not disclose methods to provide the positioning accuracy that would permit efficient delivery of the stickers. It is also difficult to "kiss cut" or die cut only through the pressure sensitive layer of a two ply label construction (i.e. self adhesive sticker paper and release base) without cutting through the base material of a two ply construction that is flexible and pliable enough to be efficiently wrapped around a product. Previous attempts have resulted in tremendous waste and inefficiency. The rolls or webs that could possibly be used to manufacture a suitable pressure sensitive material are generally narrow, adding to the expense and inefficiency since labels are generally produced on wide web or sheet fed presses that allow for fast and efficient manufacturing.

SUMMARY OF THE INVENTION

The present invention relates to the addition of value to a consumer package, or portion thereof Through the addition of a play or collectible premium to the packaging. The play premiums of this invention are integrally provided as a premium on a portion of a consumer package to increase the value of the product package or advertising. The collectible premiums are positioned on at least one surface of the consumer packaging for the use and enjoyment of children or adults who purchase or consume the products in the can, bottle, wrapper, container or other package. In a preferred embodiment, the collectible or play premiums are positioned on either the front or the back face of the packaging. Once the packaging containing the premium is emptied of product, trimmed, if necessary, or removed from the container and/or separated from the label, the premium is available for the use and enjoyment of a child or adult.

In one embodiment, the play premium is a sticker and the sticker is produced directly on the surface of a label. Advertising graphics related to product identification and/or source or other information is added to the label. Preferably the stickers are produced on the label at the same time as the label is printed with advertising or other information. The simultaneous manufacturing of the stickers onto the labeling material by printing applying glue, die cutting and trimming assures that the application equipment will not be hampered by stacks of uneven labels that bulge or stick together because of glue coatings or uneven label trimming. The stickers are integral with the label and the label with the stickers has an essentially uniform thickness.

The present invention also relates to a method to produce and dispense labels that does not require any special application equipment in the manufacturing plants or changes in the manufacturing process at the packaging, canning or bottling facility. Unlike stickers "die cut" into relatively thick materials, such as standard weight pressure sensitive materials, the labels of this invention do not significantly slow down the production lines, and the process is not affected by heat or cold from the cans or containers as they exit the manufacturing line and are affixed onto the container.

By producing the premium directly on the back or front surface of the label, one is assured that the premium is delivered on each and every package that moves through the packaging line. Electric eyes verify that every package is labeled on the packaging line. When premiums are independently affixed to a package, it is much more difficult to confirm that the premium is on every container. When premiums are independently affixed to a package, both accurate placement of the premium and even delivery of the label or premium on every product is reduced. The use of a sticker or stamp premium that is integral with the label assures that the premium is delivered to each package and this invention provides options for delivery of the premium using a label material of about the same weight, grade and performance as the material that is currently in use in the consumer product. Little or no additional verification equipment becomes necessary and no substantial reengineering, retooling or reconfiguration of the packaging process is needed. The present invention can be incorporated into wrappers, boxes, liners, bags, tubes, covers, tubs, trays and other containers or barriers for food or beverage or other packaged goods and products, particularly where the premium can be integrated into the advertising message.

In a preferred embodiment of this invention a flexible label for consumer packaging is disclosed that includes a first layer, visible to the consumer, comprising advertising identifying the consumer product; and a back layer, wherein the label comprises at least one collectible sticker premium positioned on at least one of the layers and wherein the collectible sticker is integral with and removable from the label. In one aspect of this embodiment, the sticker is positioned on the front face of the label and in another aspect, the sticker is positioned on the back face of the label. In a preferred embodiment there are more than two stickers on the label and in another embodiment there is a single large sticker on the label. The label can be adapted to be affixed to the consumer package and in one embodiment there is a zoned area on the label suitable for affixing the label to the consumer package.

In one aspect of this embodiment, the label is positioned on a can, canister, jar or bottle. In another aspect the label or wrapper is formed as a pouch or bag, a cylinder, liner material or a tube. The label can also be part of a stack of labels, such as would be present during the assembly process.

The labels of this invention can be positioned on a variety of consumer packaging. In one embodiment, the label is positioned on a package containing a food or beverage and in another embodiment the label is positioned on a personal care product package. In another embodiment the label is positioned on a cleaning product and in another the label is positioned on audiovisual packaging polymeric material.

In another aspect of this invention the invention relates to a multi-layer flexible label or wrapper comprising a first layer having a front face, visible to the consumer, comprising advertising identifying the consumer product, a second layer having a back face comprising a removable sticker, and a third layer affixed to a consumer package wherein the first and second layers are removed together from the consumer package. In one embodiment, the consumer package is selected from the group consisting of food or beverage packaging, personal care packaging, and audiovisual packaging. In another embodiment the label is positioned on a can, canister, jar, bottle, pouch, cylinder, or tube.

In a further aspect of this invention, the invention relates to a flexible label comprising: a front face, visible to the consumer, comprising advertising identifying the consumer product and a back face, wherein the label comprises at least one transfer premium printed on the label. Preferably the transfer is selected from the group consisting of a finger puppet tattoo, finger nail applique, earring tattoo, bracelet, and transfer disguises. In another embodiment of this aspect of the invention the transfer is a decorative transfer for fabric or a transferable decoration for a food item. Alternatively the invention includes a comic strip type scene printed on the article comprises a transfer.

In a further aspect of this invention a flexible label or wrapper for consumer packaging is disclosed comprising a front face, visible to the consumer, comprising advertising identifying the consumer product and a back face, wherein the label comprises at least one painting, folding, tearing, cutting, drawing or scratch-type activity printed on the label. In one embodiment a painting activity is positioned on the article and preferably the article further comprises water moistenable paints. In another embodiment the article comprises face paints and in another the article comprises color-bleed paints, frosted inks, invisible inks and water-soluble inks. In yet another embodiment, the article comprises a hidden image and/or a scratch-suitable varnish. In one embodiment the article further comprises a laminate or varnish to facilitate repeat use of the drawing or painting activity. In one aspect of this embodiment, the activity is selected from the group consisting of puzzles, mazes, games, and figures. In yet another embodiment, the activity is a folding activity and at least a portion of one face of the article comprises a printed foldable image. In another, the activity is a tearing activity comprising creating disposable jewelry and preferably the jewelry comprises at least one bracelet. In another embodiment, the article comprises a heat-responsive material that is isolated from the label. In another embodiment the article comprises a water-soluble, readily dissolvable paper.

In another aspect of this invention the invention relates to a flexible label for consumer packaging comprising a front face, visible to the consumer, comprising advertising identifying the consumer product and a back face wherein the label comprises at least one solarchromtic, thermochromatic or glow-in-the-dark type or scented ink printed on at least a portion of a face of the label or wrapper. In a preferred embodiment, the scented ink is activated by scratching the ink. Preferably the article can be used in standard automated labeling machinery.

In another aspect of this invention, a flexible label or wrapper for consumer packaging comprising a front face, visible to the consumer, comprising advertising identifying the consumer product and a back face comprising an image, color pattern or figure and an opaque coating positioned over the figure, color pattern or image, wherein scratching of the coating reveals the figure, color pattern or image.

In another embodiment, the invention relates to a flexible label for consumer packaging comprising a front face, visible to the consumer, comprising advertising identifying the consumer product, a back face and a liner covering a food wherein a premium is positioned on at least one surface of the label or wrapper and wherein the label or wrapper has a substantially uniform thickness. Preferably the premium is positioned on the liner of the article and in another preferred embodiment, the premium is positioned on a face of the article.

Another embodiment of this invention relates to a multi-layer flexible label or wrapper for consumer packaging comprising a front face, visible to the consumer, comprising advertising identifying the consumer product and a back face, wherein the label comprises at least one flap that can be lifted to reveal a hidden image or message. In another embodiment, the invention relates to a flexible label or wrapper for consumer packaging comprising a front face, visible to the consumer, comprising advertising identifying the consumer product and a back face, wherein the label comprises at least one seed. Yet another embodiment relates to a flexible label or wrapper for consumer packaging comprising a front face, visible to the consumer, comprising advertising identifying the consumer product and a back face, wherein at least a portion of the label or wrapper comprises tenticular lens material.

The invention also relates to a method for printing a tattoo onto a wrapper or label comprising the steps of adding ink to a photopolymer plate via a rubber blanket fitted on an offset press, transferring the ink to a set of one or more rollers to offset the flexographic image, and transferring the ink from the rollers to a sheet that is then used as flexible label stock for consumer packaging.

BRIEF DESCRIPTION OF THE DRAWINGS

FIG. 5 provides an illustration of a label for delivery of a premium that uses multi-layer construction.

FIG. 6 is a perspective view of a preferred painting premium according to this invention.

FIG. 12 illustrates the use of thermochromatic inks in play premiums or labels or wrappers.

DETAILED DESCRIPTION OF THE PREFERRED EMBODIMENTS

Figure 1:
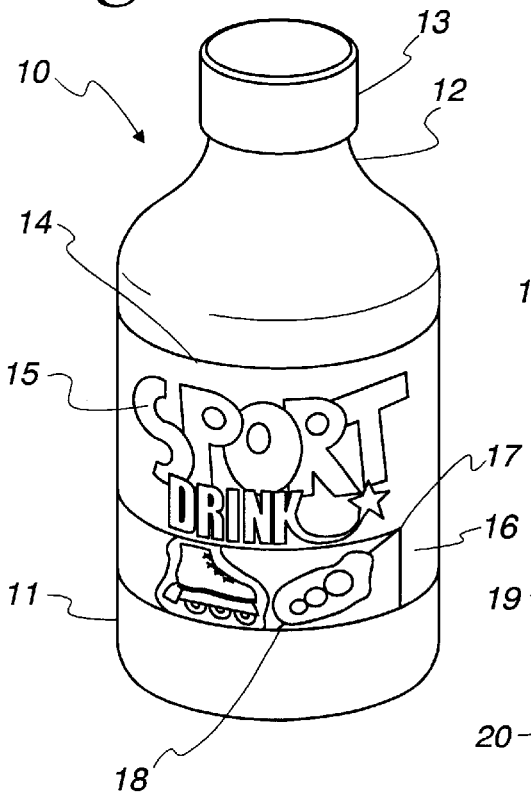
FIG. 1 is an illustrative perspective view of a bottle having at least one sticker as taught by the present invention.

The present invention relates to collectible or play premiums presented on the surface of consumer packaging to provide added value to the packaging and therefore, added value to the product contained in the packaging. The collectible premium or play premium provides an incentive for the initial and repeat purchase of the consumer product. In addition, the collectible premium integral with product designators gives value to the product identifier information and this information is kept, because of the play or collectible premium, after the consumer good has been consumed.

The term "sticker" refers to a flexible printed material, of interest to children or adults for collection, trade or play that includes a first surface with an image printed thereon and a second surface having an adhesive such as a self adhesive, for example, a pressure sensitive adhesive, or a remoist adhesive, for example, a surface that is made adhesive through the addition of moisture to the second surface.

The term "label" is used interchangeably with "wrapper" and is used herein to refer to all or a portion of a consumer package where the label or wrapper includes a product identifier, a product source/manufacturer identifier, bar codes, nutritional information, and the like. Thus, the labels of this invention may include all, or a portion of a removable portion of the packaging, whether or not the removable portion is a paper label, a plastic label applied with an adhesive, perforated labels, a wrapper, or the actual packaging itself, such as a paper or polymeric film pouch. For example, the label of a can, paper or synthetic film laminated onto cardboard packaging. Tubes, bottles (both glass and synthetic, including squeeze type bottles, juice-type bottles, asceptic cartons, milk jugs, cartons and the like), wrappers, bags, pouches, tubs, cups, including cups with seals or wrappers over the top of the container opening on lids as well as bowls and trays, and the like also serve as packaging that can incorporate the labels of this invention. Importantly, the play premium or collectible premium of this invention are integrally formed with the label material. Preferably, whether on the front or on the back face of the label, the play premium or collectible premium is an integral portion of the advertising message and is connected with the material containing the advertising and/or message printing. The term "integral" as used herein refers to the notion that many of the premiums are not merely additions to the label, but are the label, whether in part or whole. Many of the premiums are prepared from unique inks or laminates that become part of the label so that the label preferably has a substantially uniform thickness across the length of the label. The premiums of this invention are also flexible and therefore distinguishable from heavy cardboard labels. The connection can exist by virtue of the premium being printed or applied directly on to the advertising. In another embodiment, the premium is added to a wrapper or liner that is separate, but adjacent to the layer of material containing the advertising message. In both instances, no or only minimal reconfiguration of the packaging or labeling equipment is needed. Preferably the play premium or collectible premium is incorporated onto the label so that the premium does not add substantial thickness to the label and so that the label, overall, is of an essentially uniform thickness. In a preferred embodiment, the addition of the premium does not add substantial variation to the length and height dimensions of the label in a way that would require additional manufacturing assembly and reconfiguration of machinery for addition of the consumer good to the label or wrapper or the application of the label or wrapper onto a container or package housing the consumer good. The labels of this invention are prepared using a flexible material. This material can then be laminated or otherwise affixed to inflexible materials such as cardboard, inflexible plastics, and the like.

The premiums of this invention can be incorporated into the labeling or wrappers for a variety of consumable or purchased goods or products including, but not limited to, consumable products such as; personal care products including, but not limited to soaps, shampoos, make-up, facial tissues, paper products, insect repellents; first aid products including, but not limited to, bandages, ointments, sunscreens, and the like; cleaners, including but not limited to, detergents, cleaning solutions, paints and sprays; audio/visual products including, but not limited to, videocassette packaging, audiocassettes, including electromagnetic tapes or compact discs, and the like; and, foodstuffs, including, but not limited to, pastas, including boxed pastas, crackers, cookies and other bakery goods, cereals, candies, gums, snacks including chips, pretzels, popcorn, nuts, pizza, produce identifiers, butter, and the like, or ice cream novelty wrappers. The premiums of this invention can be incorporated into labels for jars, cans, containers or bottles including, but not limited to, jams, peanut butter, vegetables, fruits, puddings, applesauce, yogurt, soups, stews, meats, cheese, condiments, microwavable products, as well as beverages including soda, juices, milk, sport drinks, beer, other alcoholic beverages, and the like. The premiums can also be included in frozen foods, including, but not limited to, frozen meal packaging, pizzas, vegetables, fruits, ice creams as well as in the packaging of concession items including popcorn, hot dog, ice cream and peanut packaging, and the like.

The labels, as defined above, of this invention include a generally planar surface with a front face comprising advertising or information that can include product identifier and/or source identifier, product logos and trademarks along with a back face, or inner surface, with the back face positioned on a surface facing the packaged goods.

In one embodiment of this invention, the premium is a sticker. In general, there are two types of stickers that are commercially available at a reduced cost. These include self adhesive-type stickers and remoist adhesive stickers. Both self-adhesive stickers and remoist adhesive stickers present challenges when they are adapted for packaging. Self adhesive stickers are produced on rolls or sheets of a paper, film or other similar material coated with adhesive. Self adhesive paper is generally laminated to a release paper or film base to provide easy release of the stickers. Generally, self adhesive material of two or more plys is considerably thicker and of a heavier weight of paper than most common paper or film labels for cans or bottles. This added weight and thickness presents problems when wrapping around a container using conventional packaging equipment. In addition to the problems of the thickness of the sticker material, the stickers can delaminate from the material and create other problems. The plies or layers of these stickers are generally one to three ply thick.

Remoist adhesive stickers (including most postage-type stamps, for example) have an adhesive applied to the surface that allows the sticker to adhere to another surface or to itself once moisture has activated the glue. Envelopes, for example, generally have a remoist adhesive applied to the flaps. Sticker with remoist adhesive can present problems since the adhesive can cause a stack of stickers to adhere together or "brick" due to moisture or humidity in the atmosphere. For remoist stickers it is possible to include a moisture barrier such as plastic, a paper slip sheet, a silicone liner or a powder coating to prevent the glue from activating due to humidity or condensation. Assurance that the liner extends in an even fashion over the label can prevent uneven stacking of the labels or wrappers in a tray or magazine to assure consistent application of the labels using rapid, automated processes.

Referring now to the figures, FIG. 1 discloses a beverage bottle 10 having sides 11 and a neck 12 adapted to receive a bottle top 13. An elongated label 14 is applied to the bottle to serve as advertising. The term "advertising" is used herein to refer to product and/or source identifiers 15 as well as logos, collectible premium-related advertising, and the like. The product and br source identifier 15 is positioned on a front face of the label (i.e., the side of the label exposed to the consumer) and the label 14 has a first layer 16 and a second layer (not shown). In FIG. 1, the label 14 also includes at least one sticker premium 17 with cut or tear guides 18, positioned on the first layer 16.

Figure 2:
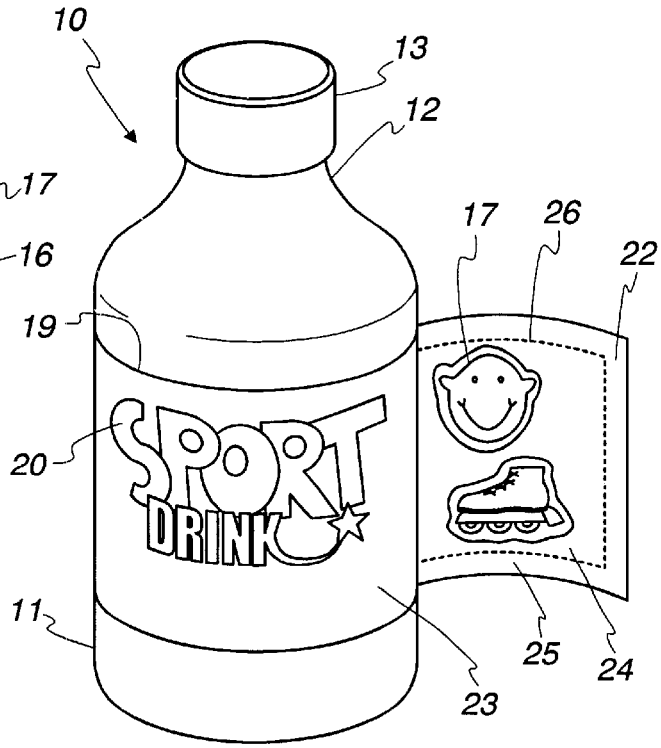
FIG. 2 is a perspective view, similar to FIG. 1, with stickers on the back face of a label.

FIG. 2 illustrates an identical beverage container 10 having sides 11 and a neck 12 adapted to receive a bottle top 13. Here, an elongated label 19 is positioned on the container to provide advertising 20 including product and/or source identification. The label 19 can also include product advertising logos, collectible premium advertising, and the like, on the front face of the label. Labels 14 (FIG. 1) and 19 (FIG. 2) are preferably removably affixed to the bottle 10, for example, using glued end portions 22, as provided in FIG. 2. Glued end portions 22 permit the label to be removably affixed to the bottle surface. Label 19 includes a first layer 23 and a second layer 25. An intermediate portion 24 of second layer 25 includes at least one sticker 17. Removal of the label 19 and removal of the sticker 17 using guide lines 26 results in a sticker having a printed surface, formerly part of second layer 25, on one side and an adhesive, such as a pressure sensitive adhesive, on the back side.

Figure 3:
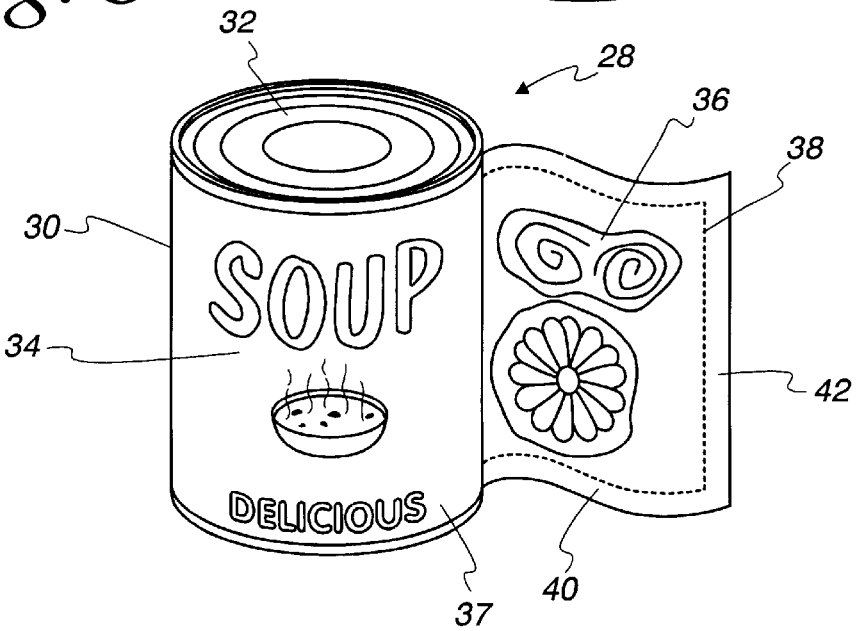
FIG. 3 is a perspective view, similar to FIG. 2, with stickers positioned on the back face of a container label.
Figure 4A:
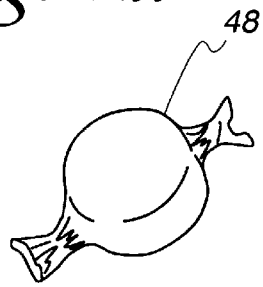
FIG. 4 is a collection of exemplary packaging that can be used to deliver the premiums of the present invention.
Figure 4B:
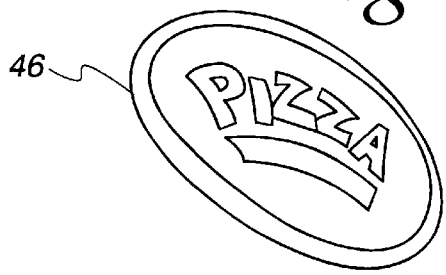
Figure 4C:
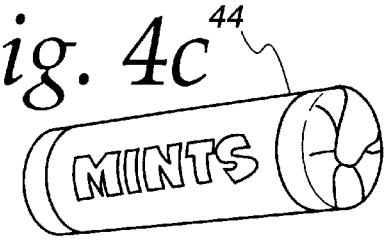
Figure 4E:
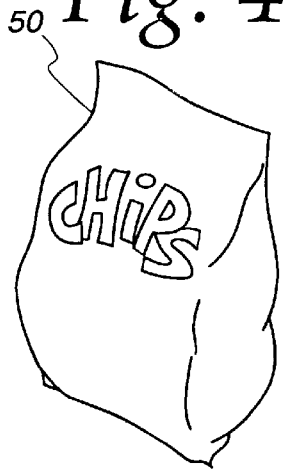
Figure 4F:
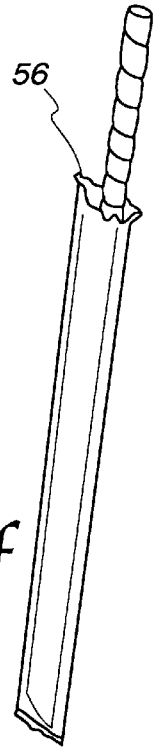
Figure 4D:
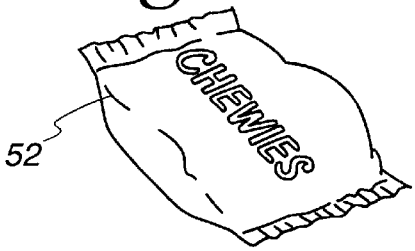
Figure 4G:
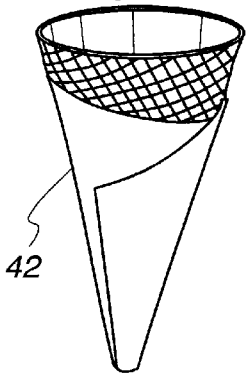
Figure 4H:
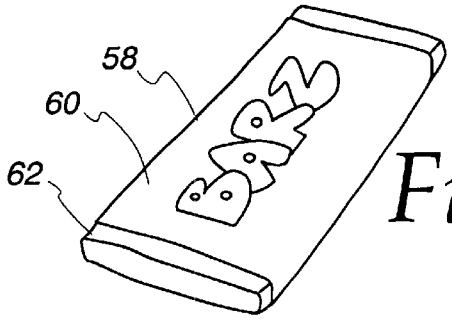
Figure 4I:
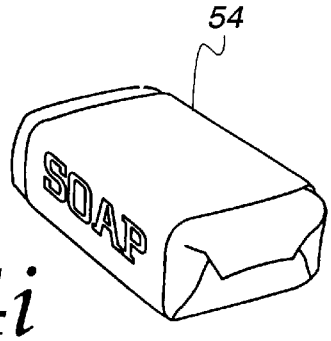

FIG. 3 is similar to FIGS. 1 and 2, in that a label is affixed to a consumer product; however, the container of FIG. 3 is a metallic container or can 28 to house consumable goods including soups, stews, meats, vegetables, pet foods, and the like. The can is formed generally as a cylinder with substantially straight sides 30, a top 32 and bottom (not shown). A removable label 34 is positioned on the can and, like the labels of FIGS. 1 and 2, the label 34 of FIG. 3 includes product and/or source identifier information on a first layer 37 and can also include product advertising logos, collectible premium advertising, and the like. In the embodiment of FIG. 3, like the container of FIG. 2, at least one sticker 36 is positioned on the second layer 40 of the label. Optionally, guide lines 38 surround the sticker to facilitate separation of the sticker 36 from first layer 37. The sticker includes a printed surface, formerly a portion of second layer 40 and an adhesive containing surface where the adhesive containing surface is separable from the first layer 37.

The ends of the label 34 preferably include an area or zone 42 for gluing or otherwise securing the label 34 to the container 28. The labels of this invention can be applied to a variety of canned goods or goods in canisters and a variety of sizes of canned goods or goods in canisters are contemplated in this invention.

Referring now to FIG. 4, there are a variety of labels or wrappers that can deliver the premiums of this invention. For example, where the premium is a sticker, the stickers can be positioned on a variety of concession-type food items. In one aspect of this embodiment, a label, in the form of a sanitary wrapper 42, paper or plastic, is positioned around an ice cream cone, either premade frozen cones, cones sold in stores or shops, or cones separately available for the addition of ice cream. The ice cream cone includes a grip portion and the grip portion comprises a label wrapped around the grip portion. The label can include a sticker or another premium positioned on the label. Where the premium is a sticker, the label is preferably prepared from a first layer and a second layer with an adhesive positioned on the back surface of the layer that includes the sticker. The sticker is integral with one of the layers and die-cuts or other cutting guidelines extend through the layer containing the sticker but do not extend through the entire thickness of the label. The sticker is removable from the layer and is preferably removable using the cuts extending around the sticker. Adhesive is provided on the back of the sticker to permit the sticker to be affixed to a variety of surfaces. Preferably, at least two edges of the label are provided with glue or other means to secure or otherwise affix the label edges to each other to position the label on the grip portion of the cone.

In another embodiment, the premiums, including the stickers of this invention, are applied to a cookie tube wrapper or to cylindrical wrapping around a food product such as a roll of candy 44. Similarly, the stickers could be positioned on other wrappers such as wrappers for refrigerator doughs including, but not limited to, cookie, roll, biscuit doughs, and the like. The wrapper could be positioned around other cylindrically shaped packaging such as rolls of cookies, canisters of snacks, such as potato chips, or the like. In this embodiment, a cylindrical tube includes a removable label with a sticker or other premium positioned on at least one layer of the label. The label is peelably removed or otherwise separated from the packaging to separate the sticker or other premium from the tube. Other cylindrical containers can include crimped ends, such as are found in packages of refrigerated dough.

In another aspect of this invention, the labels of this invention are applied to frozen foods including frozen pizzas 46, and the like. In one aspect of this embodiment, a label is included in a pizza package. The stickers or other premiums are included within transparent packaging. The label is preferably positioned over the pizza and includes advertising that is visible to the consumer. In one embodiment, the sticker or other premium is positioned on a layer on the front surface of the label and in another embodiment the premium is positioned on a layer on the back surface of the label. Those of ordinary skill in the art recognize that the label embodied within this embodiment includes a variety of transparent packaging for any of a variety of consumer products including, but not limited to, individually wrapped candies 48, snack bags, such as potato chip bags 50, pouches 52, soaps 54, straw wrappers 56, gum packaging and candy bar packaging 58.

In the pouch-type embodiment 52 of this invention, the label is formed as a pouch to enclose candies, seeds, snacks, and the like. Crimps or sealed portions keep the candies, or the like, from escaping the sealed pouch. The pouch is generally prepared from a material comprising paper or a printable, flexible, polymeric product and front preferably includes advertising such as product and/or source identifiers. The pouch itself functions as a label and where the premium is stickers, the label is again prepared in at least two layers with a layer facing the consumer that comprises advertising and a layer facing toward the interior of the pouch. The premiums provided on pouch-type packaging can be positioned on the inside face of the label; however, it is understood that the premiums can extend around all or a portion of the inside face of the pouch. Alternatively, the premium can be positioned on the layer of the label facing the consumer.

In candy bar-type packaging 58 or other multi-layered packaging that comprises an outer wrapper 60 and an inner lining 62, the premiums of this invention can be incorporated on the advertising surface of the outer wrapper 60 or on the inner aspect of the outer wrapper, similar to the embodiments of FIGS. 1–3. In addition, the premiums of this invention can be incorporated on the outer aspect of the inner lining 62 or on the inner aspect of the inner lining 62 adjacent to the candy.

Figure 23:
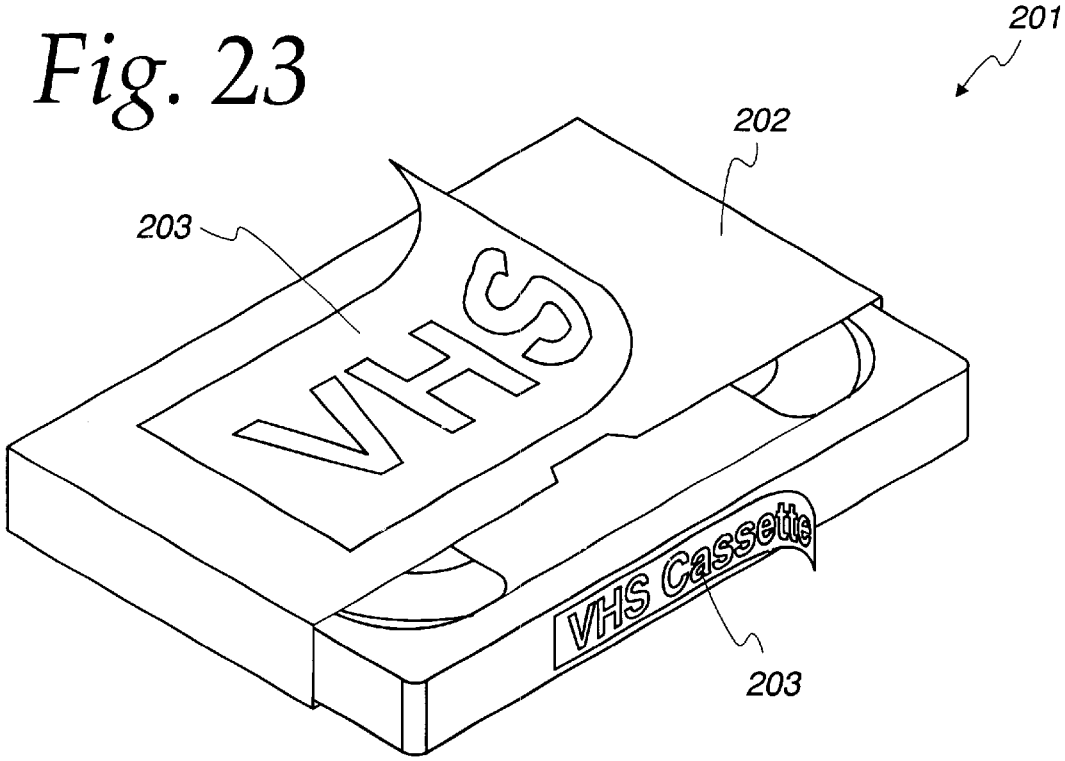
FIG. 23 illustrates a wrapper or label utilized for an audiovisual product.
Figure 24:
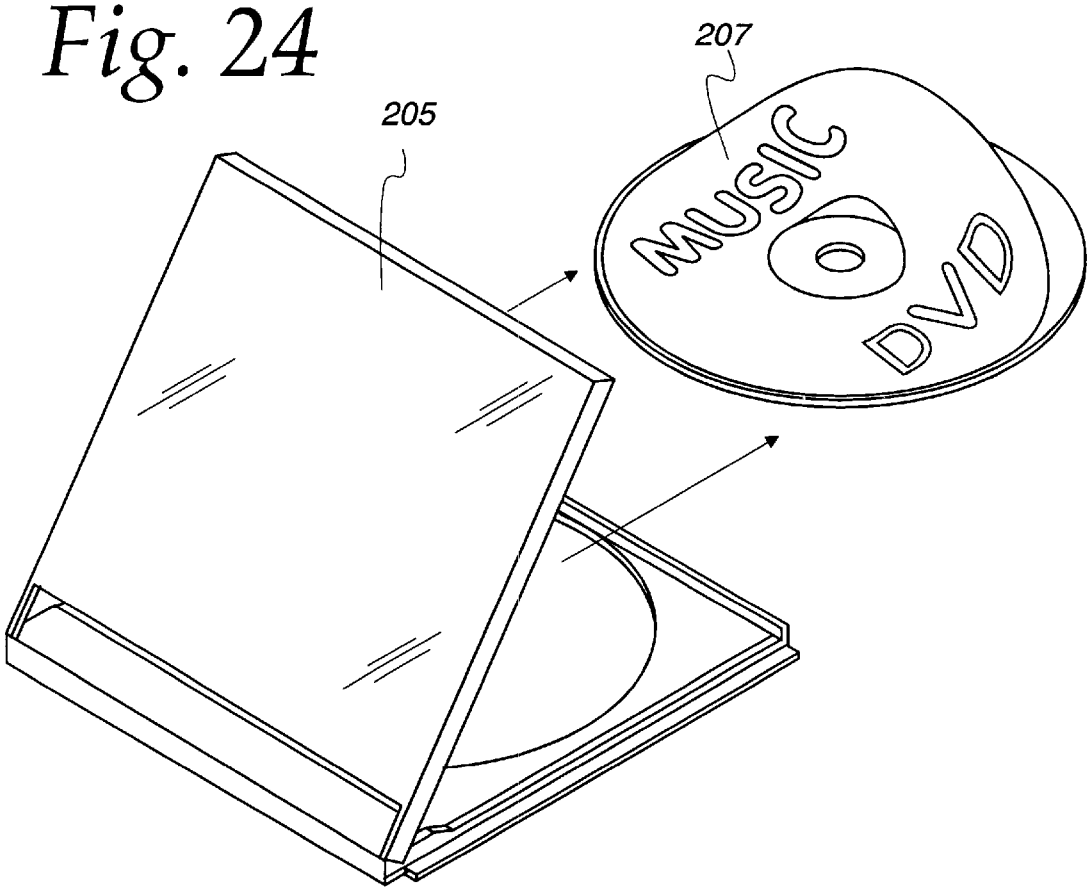
FIG. 24 illustrates a wrapper or label utilized for a computer or compact disk.

Other products utilizing the packaging of the present invention are shown in FIGS. 23 and 24. In FIG. 23, a label 203 is applied to a box or package 202 for an audiovisual product 201 which may contain a video tape for recording or playing in a video recorder/player (not shown), while FIG. 24 discloses a package or box 205 for a computer disk or compact disk having a label 207 applied thereto. The disk may alternatively be used as an audiovisual product such as a DVD disc.

Where the label or wrapper incorporates one or more pressure sensitive adhesive stickers, the label or wrapper preferably includes at least two layers, a first layer and a second layer. The two layers are affixed to one another. One layer includes product advertising identifying the consumer product. Sticker images are printed on either the first or second layer and an adhesive layer is interposed between the layers and is positioned on the back surface of the layer that contains the printed sticker image. Cuts circumvent the sticker image and extend entirely through the layer with the sticker image but preferably do not extend through the layer that does not include the sticker image. Preferably, the cut lines around the printed image form peel guidelines to peelably remove the printed sticker image from the label.

Figure 5A:
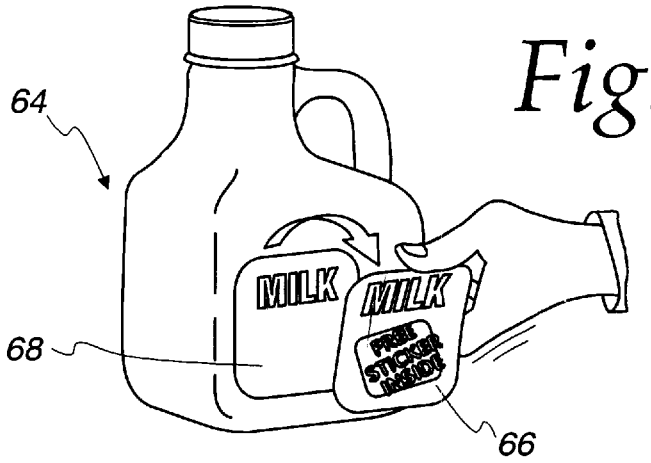
FIG. 5A is a perspective view of the label removable from a beverage container.
Figure 5B:
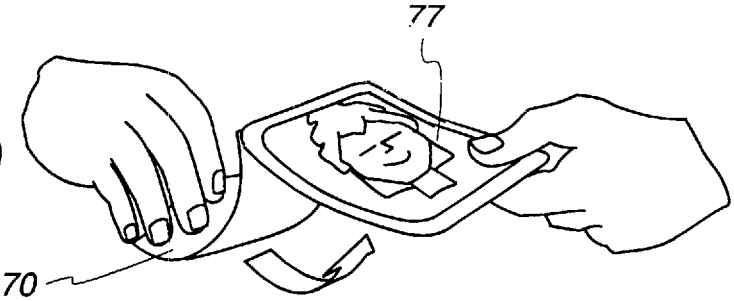
FIG. 5B demonstrates the removability of a sticker premium from the label of FIG. 5A.

FIG. 5 demonstrates another embodiment for delivering premiums, and particularly stickers, according to this invention. In this embodiment stickers or other premiums are provided in a multi-layer construction held in place using dry release adhesive or adhesive extensions. In FIG. 5A a milk carton or jug 64 contains a label 66 having advertising positioned over a second label 68. Label 66 is affixed to 68 and to jug 64 using a dry release adhesive (such as that available from Promo Edge, Neenah, Wis.) corresponding to U.S. Pat. Nos. 4,621,442 and 4,621,837, or extension wings that comprise a peelable adhesive. The wings or rails are known in the art and are created, for example, using a laminate of film or paper materials with perforations on the ends to separate the plys Label 66 is preferably prepared in a three or multi-layer construction as provided above. Label 66 comprises a first layer, with a front side 70 visible to the public and a second layer 72 affixed to the back side of the first layer (FIG. 5B). Once removed from the container, the sticker is removable, preferably from the second layer 72 of the three-layer construction the third layer remains on the product as an identifier. This type of label can be positioned on a variety of consumable products including, but not limited to fruit, soaps, beverages, and the like.

The sticker premiums of this invention can include a variety of figures or messages including cartoon characters, action figures, sports personalities, artist renditions, trademark logos, removable recipies, and the like, that are attractive to children, adults, or both. The labels of this invention can include one or more stickers positioned on the surface of the label. For example, a single long sticker can be used as a "bumper sticker" or as a sticker for notebooks or for a bike. The stickers can be smaller and used for light switch plate covers, or as pencil wraps. Alternatively, there can be a few or a large number of stickers on the label with a single repetitive image or a variety of images. The stickers themselves can include a novelty aspect, such as flavored stickers, fragrance enhanced stickers, glitter stickers, glow-in-the-dark stickers, colorable stickers, reflective stickers, holograms and the like.

Preferably the stickers are positioned on the consumer label "in register" meaning that the sticker image is consistently and repeatably positioned on the label in substantially the same location. In a preferred embodiment of this invention, one or more images will be discretely positioned on the surface of the label to guarantee that each label received contains an image positioned in the desired location.

The sticker premiums of this invention can be prepared using a variety of processes known in the art. For example, a first layer can be printed with advertising identifying the consumable good, a layer can be printed with a sticker image and a base ply. Adhesive is applied to the layer having the sticker image and the layers are positioned adjacent to one another with the adhesive positioned between the first and second layer. Additional adhesive can be used, for example, at the edges of the label to ensure that the first and second layers remain affixed to one another.

The sticker premiums are readily removable from the label when the consumer product is purchased. Cutting guidelines can be positioned on the front face of the labeling to aid in the removal of the label from the consumer product without destroying the collectible sticker premium. Cuts, perforations or scorings around the sticker images provide peel guidelines to facilitate removal of the sticker image from the label.

The sticker premiums can be affixed to a variety of surfaces, such as paper, hands, clothing, and the like. They can be collected in books or applied to posters. Stickers can also be unprinted or printed in solid colors only and die cut in shapes that can then be removed by the consumer and placed on a surface to create mosaic designs. Further, the base ply of the label can be printed in one or more colors to create a scene upon which individual stickers can be placed. The stickers can then be repositioned to change the scene if the child wishes.

In another embodiment of this invention the play premium is a transfer such as a temporary tattoo, including comic strips with transferable tattoos, finger puppet tattoos, finger nail applique, earring tattoo or other jewelry tattoos, bracelets, transfer disguises such as moustaches, scars and moles, decorative transfers for fabric, and transferable decorations for hard-boiled eggs or for other food items, such as pumpkins, apples, and the like. Comic strips with scenes that are printed in a combination of water soluble or transfer inks and permanent inks allow a child to read a comic strip and then transfer the characters from the strip to the child's skin. Alternatively solid outlines can be transferred from the back of a label to be transferred to the skin and a pallet of paints can be used to color in the images. A variety of inks are known for transfers and these include, but are not limited to, Colorcon inks (West Point, Pa.) for water soluble tattoos, semi-permanent tattoos, heat transfer iron-on-sublimation ink systems, and the like.

The inks used for transfers can be printed using one or more standard printing techniques such as, but not limited to, sheet fed dry offset, letter press, silk screen, flexography or gravure printing. Ink systems are commercially available for producing these premiums from a variety of manufacturers including suppliers such as Colorcon (supra). The techniques, inks and printing methods to commonly produce most transfers differs from the high speed, high volume methods of printing standard labels and wrappers making the combination of the two media unique. Transfers require a uniform smooth surface and use printing methods that generally require printing on narrow with equipment running at slower speeds. Special care is needed to provide proper collation and cutting of the labels to prevent the inks from sticking together and causing the labels to "brick" or to harden.

Figure 8A:
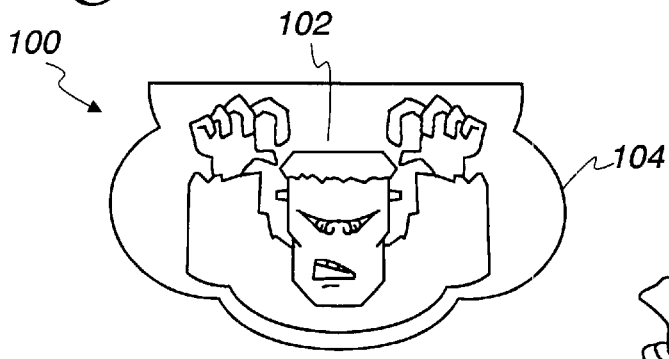
FIG. 8A provides the image and 8B illustrates a preferred method for application.
Figure 8B:
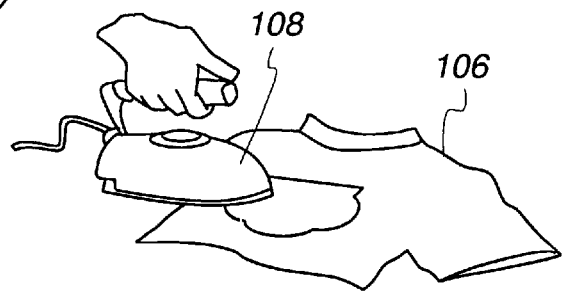
FIG. 8 is a perspective view of a label or wrapper comprising a fabric transfer image.
Figure 8C:
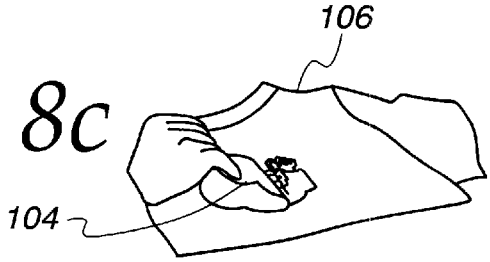
Figure 9A:
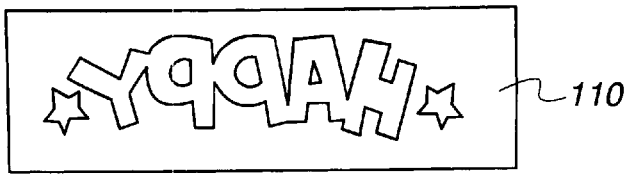
FIG. 9A is a perspective view of a rub-down type transfer.
Figure 9B:
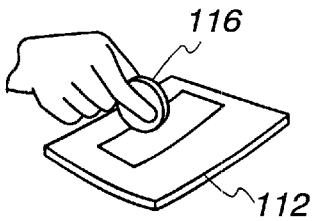
FIG. 9B illustrates the transfer to paper and FIG. 9C illustrates the transfer to skin.
Figure 9C:
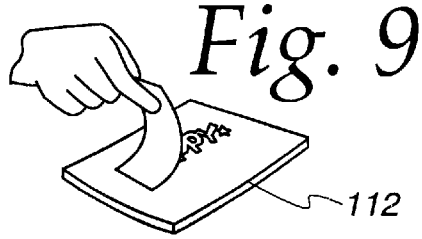
Figure 9D:
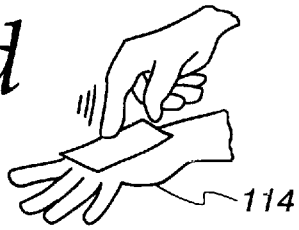
Figure 9E:
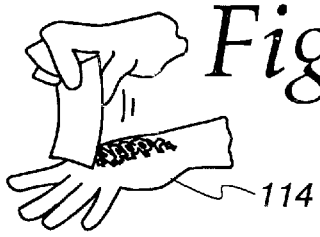

Fabric transfers such as t-shirt or clothing transfers are another aspect of this invention. FIG. 8A provides an illustration of an exemplary fabric transfer image 100 that is positioned on the back surface 102 of a label 104. Sublimation dyes available from Colorcon or other ink suppliers can be used to print an image in reverse on the back surface of a label. The image can then be transferred to a t-shirt 106, jacket, handkerchief, or the like using heat, such as heat from an iron 108 (FIG. 8B). Such transfers can also be supplemented with a pallet of sublimation dyes or paints that can be printed on the label to permit the consumer to apply color or designs to the transfer with a with a brush swab or other methods before bonding the image on the fabric using heat, from example, an iron. U.S. Pat. No. 4,308,679 to Ray Ill et al. teaches the addition of a transfer to a rigid side cardboard carton but this is provided as an added piece to the cardboard and is not integral with the advertising portion of the label or wrapper and the addition to the packaging rather than as an integral piece of the packaging can add unnecessary cost to the packaging process.

Other forms of transfers include "membrane" or "rub down" type transfers where a thin latex or other flexible polymer membrane used to print an image such as a character, lettering or a photograph in one or more colors in reverse. As illustrated in FIG. 9, these types of transfers can be printed onto the back or the front of a label 110. The transfer is preferably also coated with a low tack adhesive to permit the image to be transferred to another surface by burnishing the back of the label that acts as a carrier sheet. The image is transferred by positioning the image on paper 112 (FIG. 9B) or skin 114 (FIG. 9C) and applying pressure such as by the use of a hard instrument 116 (FIG. 9B) or by generally rubbing (FIG. 9C) over the back of the transfer. When the image is transferred, the transfer is clean, leaving no or minimal ink on the carrier sheet label.

In general, the inks and ink systems are available commercially for specific applications and are produced using a variety of traditional printing methods. Advantageously, the transfer premiums do not add sufficient bulk. Therefore, standard labeling/wrapping machinery can be used without substantial reconfiguration.

The invention also relates to the incorporation of painting and/or drawing activities added to a label or wrapper where the label or wrapper comprises advertising identifying or relating to the consumer product. For example, a variety of water soluble inks are known that can be deposited onto a surface alone or in combination with a printed figure. Wetting of the paint with a solvent, typically water, using an application tool such as a brush, finger or swab provides a premium painting or drawing activity. A variety of ink systems to permit painting and/or drawing activities are known in the art including, but not limited to, water soluble, printable inks, black bleed color (i.e., permanent inks blended with soluble inks) printing systems that print black or other colors, but bleed a color when wet, and ink dye or makeup systems suitable for face painting, such as to use as a mask or make-up.

Figure 6A:
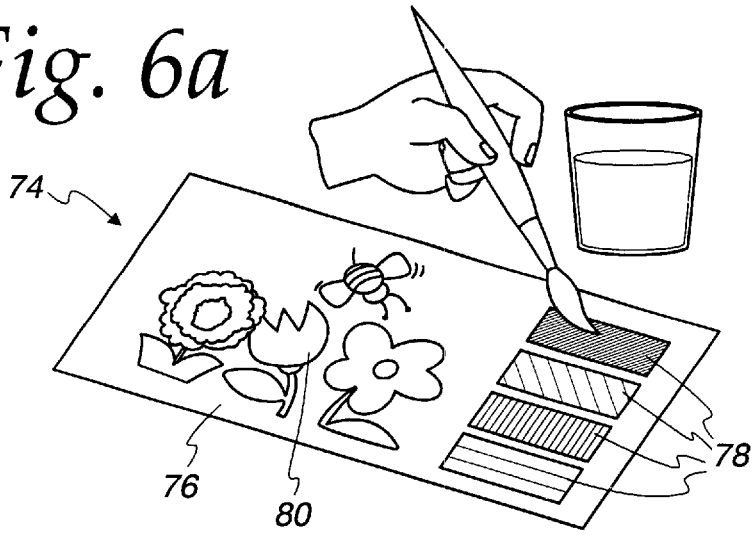
FIG. 6A illustrates the moistenability of paint positioned on the label and FIG. 6B illustrates the transferability of the paint to another image.
Figure 6B:
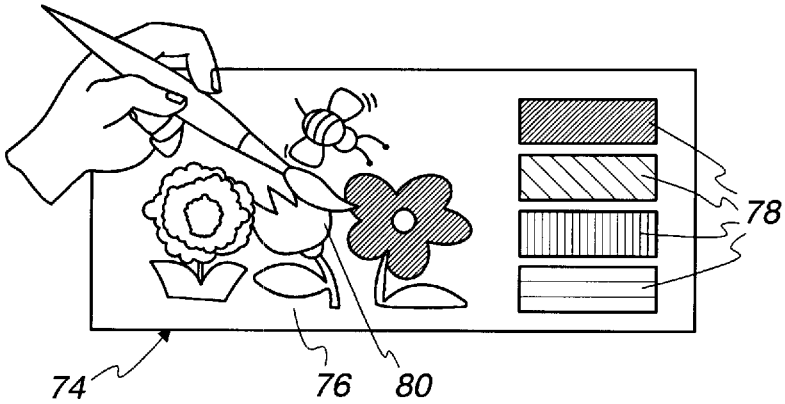

FIG. 6 provides an example of a painting activity using a label or wrapper. In this example, a label or wrapper 74 is removed from the consumer product. The label includes a front face with advertising (not shown) and a back face 76 that was adjacent to the consumer good and not visible to the consumer at the time of purchase. Water moistenable paints 78 are printed in block on the label and a coloring activity 80 is also printed on the label. The application of a solvent, preferably water, to the printed paint (FIG. 6A) results in the transferability of the paint to another location, such as a printed image 80 on the label (FIG. 6B).

Other painting activities include rainbow painting using frosted inks. These activities can be readily incorporated as premiums onto the labels or wrappers according to this invention. For example, a label can be printed in one or more colors and then coated with a "frosted" ink. Such inks are available from a number of ink manufacturers and provide an opaque or near opaque effect when covering a printed image. When these inks are wetted using a brush, cotton swab or finger tip, they become temporarily invisible to reveal an image or color beneath their surface in much the same way that a warm finger can create a picture on a steamed winter window. When the ink dries, the picture disappears and the premium can then be reused.

Inks used for painting and/or drawing activities can typically be printed onto a variety of substrates using a variety of printing techniques. For example, water soluble inks and black bleed inks can be used in many major printing methods. Face painting inks can also be printed using a variety of techniques known in the art, including but not limited to flexography, rotogravure, screen printing, letter press, dry offset processes, and the like. Face painting can be delivered as a premium in a form similar to FIG. 6 except that the paint is transferable to skin for face or body painting. Other painting and drawing activities known in the art can be added to labels or wrappers where the label or wrapper comprises advertising identifying a product and/or its source. Alternatively, the activity can be positioned on a liner such as an inner liner 62 for gum or candy bars, as diagramed in FIG. 4. Inks are known that when dry and printed have muted hues. The addition of a solvent, such as water, with an applicator to the ink on the label or wrapper results in vibrant color once the ink is moistened. Such ink systems are available from Colorcon (supra), or Handschy Inks (Chicago, Ill.). Inks can also be positioned on a label or wrapper surface as moistenable inks to use with stamps. The label, in effect, becomes a stamp pad for rubber stamps, sponges or vegetable cut stamps.

Water soluble and invisible inks can also be combined and used to provide premiums according to this invention. An invisible ink or varnish can be printed on a label near an area of water soluble ink. When a solvent, generally water, is applied, the invisible message or picture becomes visible. Similarly frosted inks, generally a white frosted ink, can be applied over an image printed onto a surface of a label or wrapper. Moistening of the surface bearing the frosted ink reveals the hidden image which disappears when the frosted ink coating dries. These inks are available from a variety of ink manufacturers. Including Kohl & Madden Inks in Minneapolis, Minn.

Hidden pictures can be applied to a wrapper or label using scratch-suitable varnishes such as those available from Kohl & Madden (supra). Similarly, water wash off inks can be applied over a hidden figure on a label or wrapper. When the label or wrapper is removed from the consumer product, wetting of the surface washes away the surface covering the ink or causes the ink to become transparent to reveal the hidden figure. Another form of hidden pictures is created by printing over an image with a removable ink that can be removed by scratching or scraping with a fingernail or coin. These coatings are generally made with a high latex content pigment that is opaque when applied. These pigments can be subsequently printed onto the label or wrapper with one or more colors to create a scene or picture. The pigment can be scraped away to reveal a hidden image such as hidden animals, word games or mazes. Ink systems are available from ColorCon (supra) for these types of hidden applications.

Figure 10A:
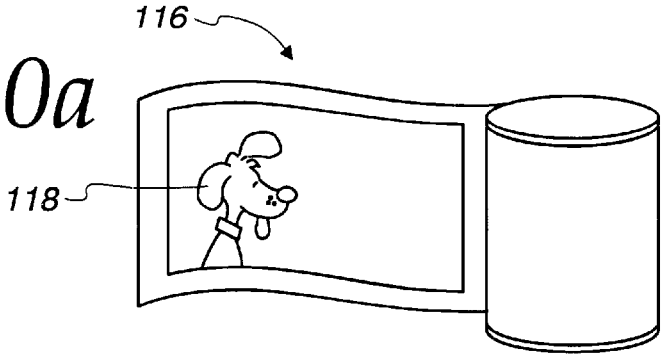
FIG. 10A illustrates a label comprising a printed image and an invisible image.
Figure 10B:
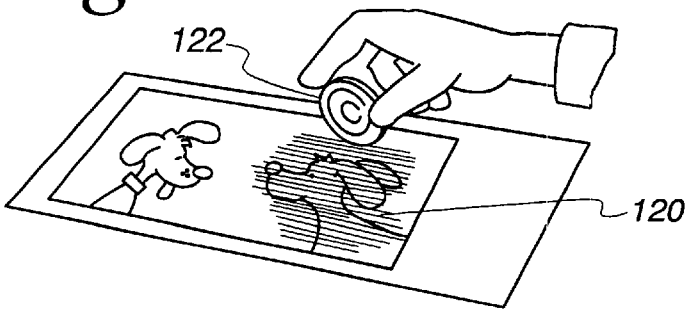
FIG. 10B illustrates an ink composition using a coin rub to reveal the hidden image.
Figure 10C:
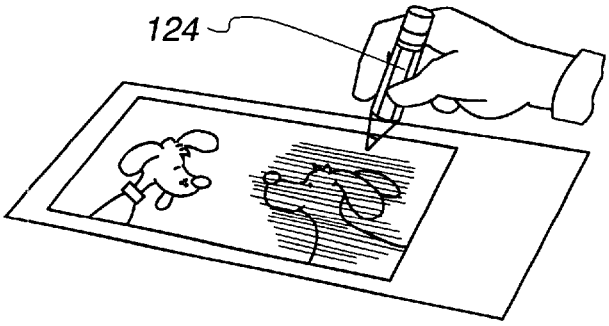
FIG. 10C illustrates an ink composition using pencil lead to reveal the hidden image.

In another hidden application, a label 116 or wrapper comprises at least one printed image 118 and an invisible image 120 or lines created using clear varnish (such as Colorcon scratch-suitable varnish) is printed in the form of a message or figure (see FIG. 10). The message or picture is invisible to the eye on the substrate until the area is rubbed with the lead of a pencil or other writing instrument, the varnish resists the lead or ink and the message or image is revealed against the residue of the pencil lead. Similarly invisible ink, generally with a white latex compound added to the formulation appears invisible when printed on a substrate. By scratching the surface with a coin the residue or dirt from the coin is transferred to the invisible ink causing it to become invisible. Rubbing of the area with a coin 122, a pencil 124, or another suitable tool results in visualization of an otherwise invisible image.

Figure 11A:
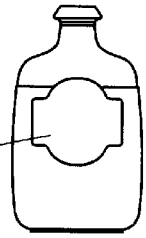
FIG. 11A is a perspective view of a label from a consumer product that comprises solarchromatic ink.
Figure 11B:
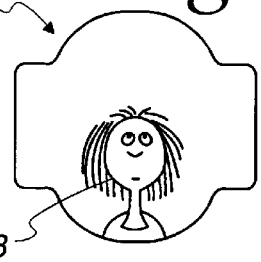
FIG. 11B illustrates the effect of sun on the label and FIG. 11C illustrates the effect obtained when the label is removed form the sun.
Figure 11C:
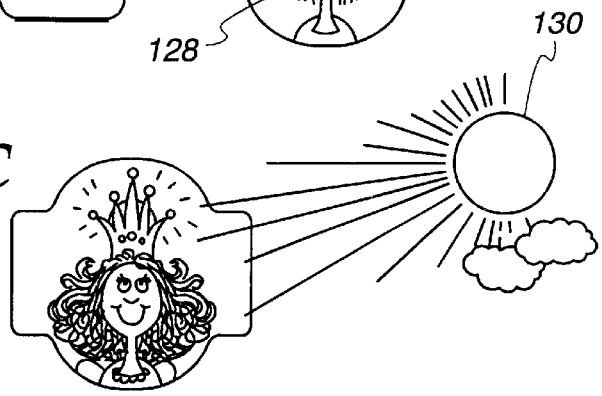
Figure 11D:
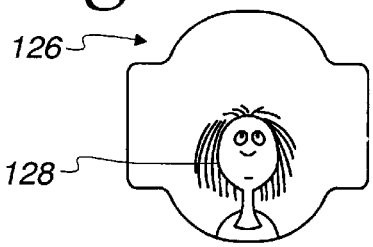

In another embodiment, the wrappers include surface modifications that permit the use of repeatable play activities. These types of activities involve other inks dyes, chemicals, substrates and the like to produce a visual effect on one or more surfaces of the label or wrapper. These include solarchromatic, thermochromatic, glow-in-the-dark or luminescent materials. For example, as illustrated in FIG. 11, one or more novelty scenes 128 or games can be achieved by printing on at least one surface of a label 126 or wrapper with a combination of regular printing inks to create part of a cartoon scene or game combined with sun activated inks that either appear or fade from view when exposed to ultraviolet light (see FIG. 11A). In such an example, the premium permits the label or wrapper to be taken out into the sun 130 to reveal the hidden parts of the picture or hidden words or characters (FIG. 11B). When the wrapper is removed from direct contact to ultraviolet radiation (FIG. 11C), the image printed in these inks disappears for view until the next exposure. Solorchromatic inks that can be used in conventional offset printing presses are distributed, for example, by Graphic Management Specialty Products (Green Bay, Wis.).

Figure 12A:
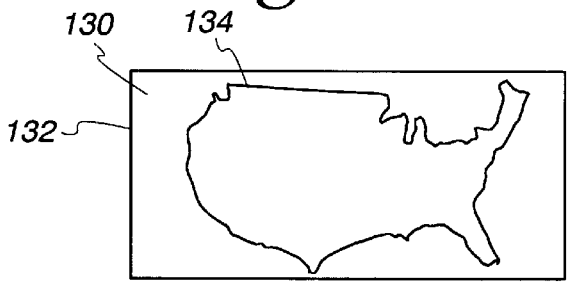
FIG. 12A illustrates a label with thermochromatic ink.
Figure 12B:
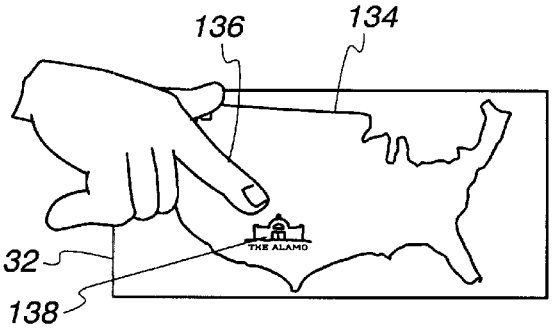
FIG. 12B illustrates the effect of ink on the label and FIG. 12C illustrates the effect caused by the removal of heat.
Figure 12C:
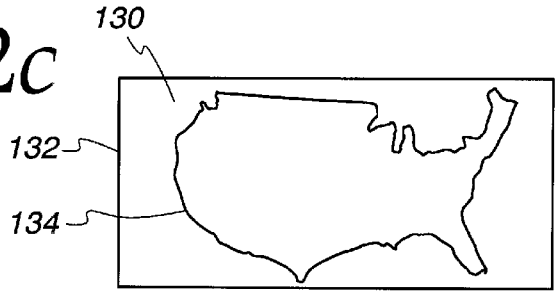

Similar effects can be achieved using thermochromatic inks and papers that can create the illusion of color pictures, text and illustrations to appear or vanish through the application of heat or cold, for example, by rubbing with a finger, hand or other object. For example in FIG. 12A, the back surface 130 of a label 132 is printed with an image 134, here a map of the United States. Rubbing 136 of an area of the image 134 (see FIG. 12B) results in the visualization of one or more otherwise hidden images 139. After a time the hidden image is again invisible (see FIG. 12C). A similar effect can be created using pressure-sensitive papers that contain a micro-encapsulated invisible ink (Minnesota Mining and Manufacturing and Craig Adhesives, Newark N.J.). The ink is invisible when dry. An image is revealed after rubbing a finger or an instrument over the area causing micro-encapsulated substances to rupture and mix, thus causing a chemical reaction that makes the hidden message or scene to become visible. Since these inks, pigments and papers can be chemically mixed to become visible or invisible at a variety of temperatures, they allow for a variety of premium applications on labels and wrappers including, but not limited to games, toys, novelties, puzzles, drawing boards, and the like. For example, the back surface of a label can be flood coated with a solid coating of a solid light tint. The consumer could use their finger as a drawing instrument to erase the tint for a few moments to create a picture. As the tint cools, color returns and the picture vanishes. Thermochromatic inks can be printed by a variety of methods and are available from the Mitsui Ink Company (Los Angeles, Calif.). Thermochromatic color change papers are available from the Touch-It Paper Company.

Figure 13A:
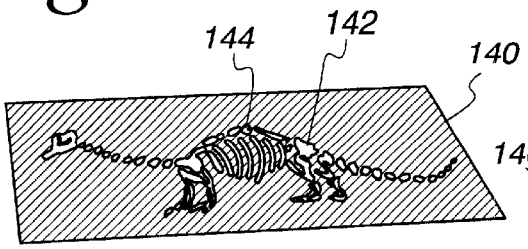
FIG. 13 illustrates the use of glow-in-the-dark inks. Preferably the label is reverse image printed with the ink (FIG. 13A), a light-visible image is printed over the reverse image (FIG. 13B) and the reverse image becomes visible in the dark following light exposure.
Figure 13B:
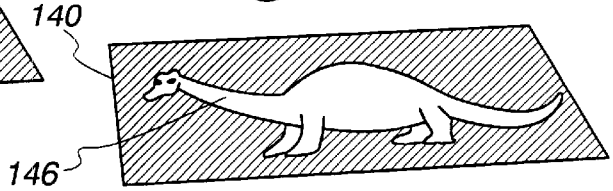

The label or wrapper can also be printed or treated with a phosphorescent ink or pigment to create glow-in-the dark premium scenes and effects. The inks are generally inconsistent with standard label printing techniques because the ink is of a much greater density than conventional printing inks. This results in a glow-in-the-dark image that is raised above the surface of the substrate when it dries. This is not suitable for standard labeling machinery. However, glow-in-the-dark premiums can be delivered using standard labeling machinery if the entire surface of the label is coated with the phosphorescent ink and then printed in a reverse image over the ink causing only a controlled portion of the label to be light sensitive. The uniform coating of the phosphorescent ink across the label insures that the stacks of labels are of a uniform thickness as required for automated feeding equipment. The glow-in-the-dark images used as premiums can include a variety of images such as dinosaurs, animals, figures and the like. In FIG. 13A, a label 140 is flood coated with a glow-in-the-dark ink 142 to create a reverse image 144 of a dinosaur. An image 146 is printed onto the glow-in-the-dark ink (FIG. 13B). When the label is removed from the consumer goods, and under light, the image of the dinosaur is evident. When the label is viewed in the dark the reverse image 144 appears. Glow-in-the-dark inks are available from a variety of ink suppliers and the preferred methods for printing the ink include flexography, silk screen or offset printing. Premiums using glow-in-the-dark inks can be combined with stickers and other premium ideas of this invention.

Figure 7A:
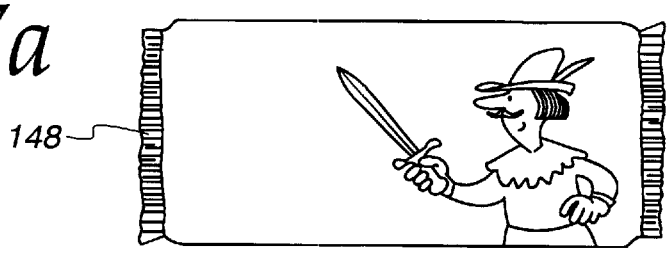
FIG. 7 illustrates a repeat use dry-erase marker (FIG. 7B) activity positioned on a pouch or bag.
Figure 7B:
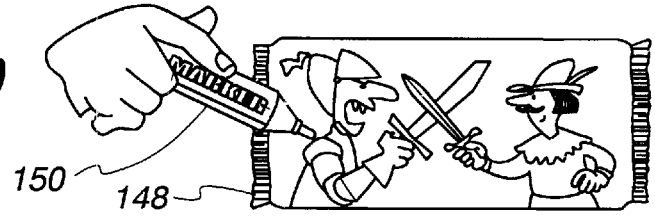
Figure 7C:
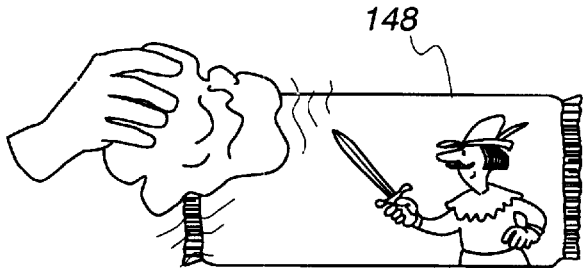

Alternatively, all or part of one or more surfaces of the label or wrapper can be coated with a varnish or laminate suitable for dry erase markers or wipe-off crayons. The surface can then also be used as a chalkboard or erase board. The coating is generally a standard varnish coating or a laminate for dry erase and a toothy or roughened texture can be used to accommodate chalk particles where a chalkboard is provided as a premium. The coating can be applied over another printed picture or over a background color to permit the user to draw a picture or words and erase then again and again. FIG. 7A illustrates a pouch 148 that has been opened to provide an image on the inner surface of the pouch. The inner surface is coated with a transparent laminate that permits repeated drawing onto the surface with a dry erase marker 150 (FIG. 7B) and the image can be erased (FIG. 7C). The activity can include a variety of puzzles, mazes, dot pictures, tic-tac-toe, illustrations to assist in the drawing of a favorite figure or cartoon character, and the like.

Figure 14A:
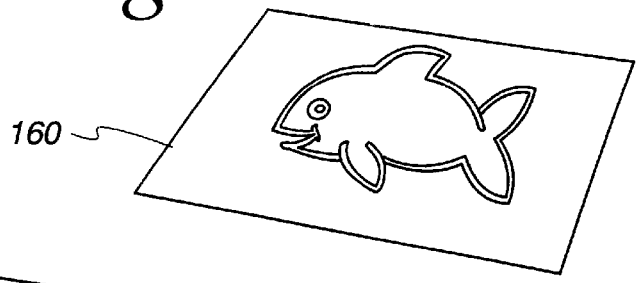
FIG. 14 illustrates a scratch art activity.
Figure 14B:
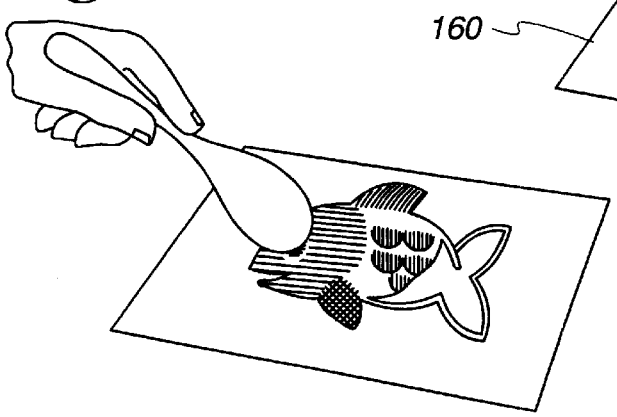

Another drawing activity premium contemplated in this invention relates to a pre-printed scene printed on a coated substrate on the label or wrapper. The coating on the substrate is generally black or some other darker color. By scratching the coating, the coating can be removed to reveal hidden colors or pictures that have been preprinted on the label or wrapper. Such an activity is provided in a label 160 of FIG. 14. This premium permits a child or adult to participate in an arts and crafts activity by allowing them to color a picture without having to use crayons or paints. Color can be revealed section by section by scraping with the edge of a utensil to remove the opaque top coating. Substrates with a preprinted top coating are available from the Scratch Art Company in Avon, Mass.

In yet another drawing premium activity suitable for use on a label or wrapper is a modified magic slate that is deliverable as a play premium on a label. In this embodiment, a two-ply label consisting of a drawing surface and a backing surface is used. The drawing surface can include a film or vinyl that is generally translucent in nature. The backing surface is preferably a solid color and generally black. This permits the top surface to temporarily cling to the bottom surface in areas where pressure is applied. The two surfaces are attached together on one end forming a two-part pad that is wrapped around a consumer product. After removing the two part composite label and placing it on a flat surface, a stylet, toothpick or other object can be used to draw a picture or message on the top surface causing the surface to cling in those areas where pressure is applied to create an image at the point of contact. The images can be subsequently erased by separating the two surfaces to redraw on them again and again. These materials can be printed on conventional presses with conventional inks. The two-ply construction of the label may require slightly different handling as compared with conventional labels; however, conventional equipment can be used to apply the premium to consumer packaging.

Figure 15A:
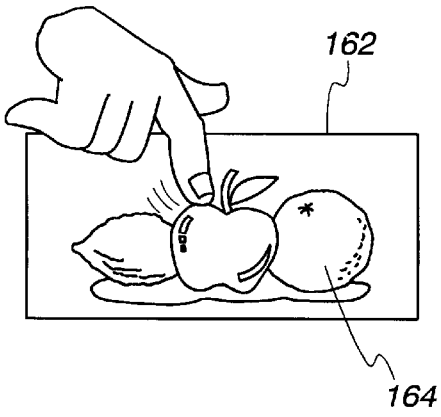
FIG. 15 illustrates a scratch (FIG. 15A) and sniff (FIG. 15B) according to this invention.
Figure 15B:
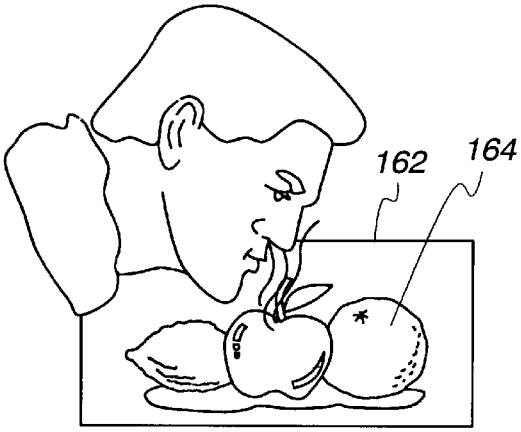

There are a variety of other novelty premiums that can be incorporated into labels and wrappers. For example, micro-encapsulated fragrance and press varnish technologies are known. This technology, known generally as "SCRATCH & SNIFF" has been used as a sampling medium for perfume companies and has been printed on inserts distributed at department stores, for use in magazines, in children's books and the like. In this invention, micro-encapsulated fragrance technology can be incorporated into the labels or wrappers either as a play premium or as a method for allowing a manufacturer to preview one or more scents either within that particular product or as a panel of scents for related products. In this technology the fragrance is incorporated into capsules and the capsules can optionally be incorporated into an ink. Abrasion of the surface containing the capsules result in the release of the fragrance. FIG. 15 provides a label 162 with at least one fragrance-associated ink image 164. Scratching of the image 164 (FIG. 15A) results in release of the fragrance (FIG. 15B). In one example, a shampoo or perfume manufacturer can incorporate their fragrance on a label for consumer use. In another embodiment, a fruit juice manufacturer can print one or more fruit scents on a particular beverage label for play or for marketing purposes. Micro-encapsulated technology is known in the art including SCIENTIFIC technologies (Sandy Alexander Inc., Clifton, N.J.) or micro-encapsulated technologies, such as those available from Minnesota Mining & Manufacturing (St. Paul, Minn.).

Figure 16:
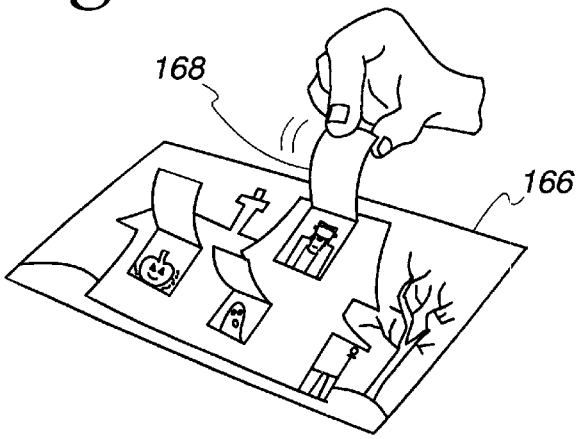
FIG. 16 illustrates a lift-the-flap type activity on a label or wrapper.

The play premium on a label or wrapper 166 (FIG. 16) can also comprise multi-ply label with flaps 168 or windows that are die cut or perforated along one or more plys of the label allowing a child to lift the flap to reveal a hidden word, picture or scene. A common hidden image activity is an Advent-type Christmas calendar and this invention relates to the incorporation of this type of concept onto a label or wrapper. The hidden windows encourage child participation and involve surprise associated with the uncovering of a hidden or missing scene.

Figure 17A:
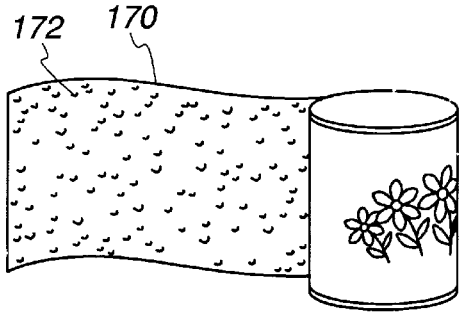
FIG. 17 illustrates the incorporation of seeds into a label or wrapper.
Figure 17B:
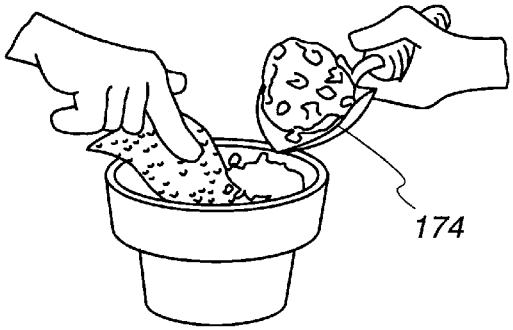
Figure 17C:
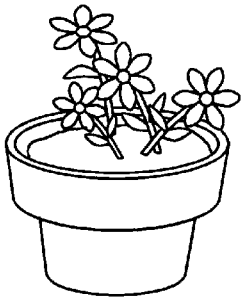

Another play premium on a label 170 (FIG. 17) or wrapper considered in this invention involves incorporating small seeds 172, such as carrot or geranium seeds, into a label or wrapper. In this embodiment, preferably the label is prepared at least in part from a substrate that is at least degradable in part to permit the seeds to germinate and grow in the presence of moisture. In one example, the seeds can be added during the manufacturing process of a paper label in the pulp while the pulp is pressed into sheets or rolls. Optionally growth promoters, such as fertilizers or plant food can also be incorporated into the labeling if desired. Seeds that are small and flat and do not substantially add to the thickness of the label are preferred to ensure that the labels can be easily dispensed with automatic labeling or wrapping equipment. The finished product acts as both a label or wrapper on a product, such as a soup can or another removable label. In use, all or a portion of the label is removed from the consumer product and at least a portion of the removed label is inserted into a container containing dirt 174 or other suitable seed germination and growth media. In one embodiment, the container is the empty consumer product. Dirt is added to the can along with water and the can is positioned in a suitable environment for growth.

Figure 18A:
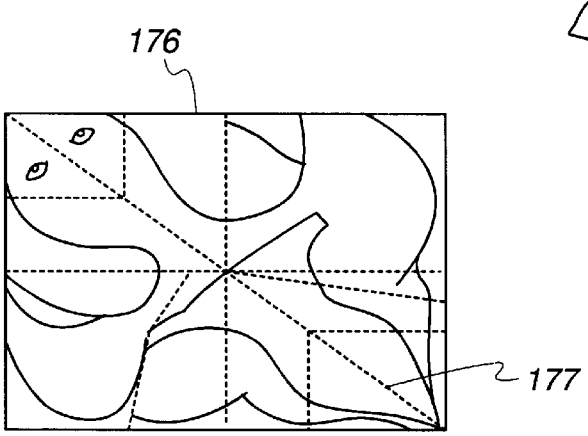
FIG. 18 illustrates a folding origami activity on a label or wrapper.
Figure 18B:
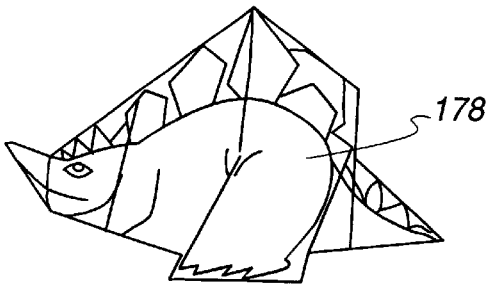
Figure 19A:
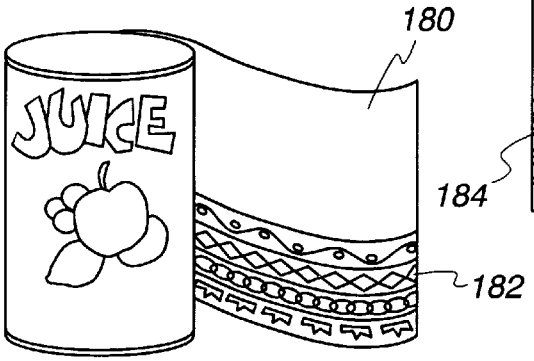
FIG. 19 illustrates the incorporation of jewelry into a wrapper or label.
Figure 19B:
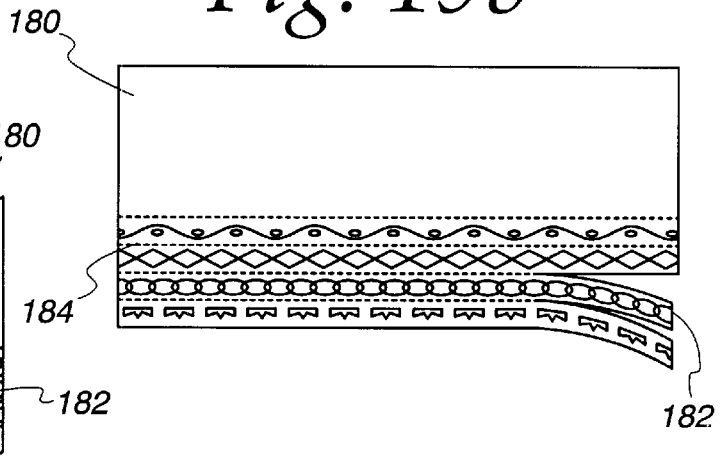
Figure 19C:
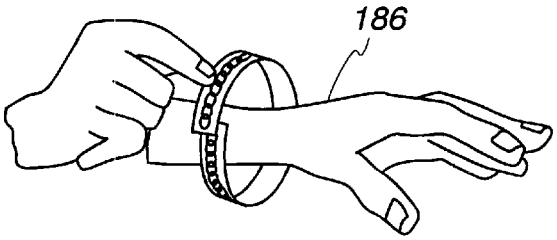

In yet another application, the label or wrapper 176 (FIG. 18) incorporates a foldable premium, such as origami figures that children can fold on designated printed lines 177 to form animals 178, cartoon characters, magic tricks, airplanes, vehicles, and the like. Similarly, the label 180 can be printed on one or more sides with graphics, such as friendship bracelets 182 (FIG. 19) that can be removed from the label by die cut or by perforation 184. The bracelets can then be placed around a wrist 186 and held in place with remoist or pressure sensitive adhesive that has been pre-applied to the label.

Figure 20A:
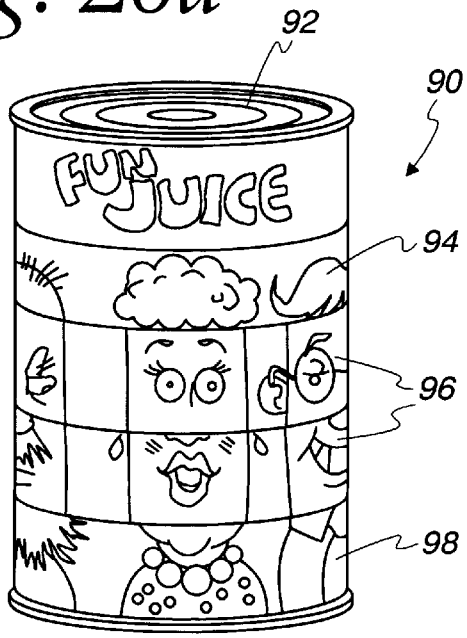
FIG. 20 illustrates a novelty activity created by rotating separable portions of a wrapper or label.
Figure 20B:
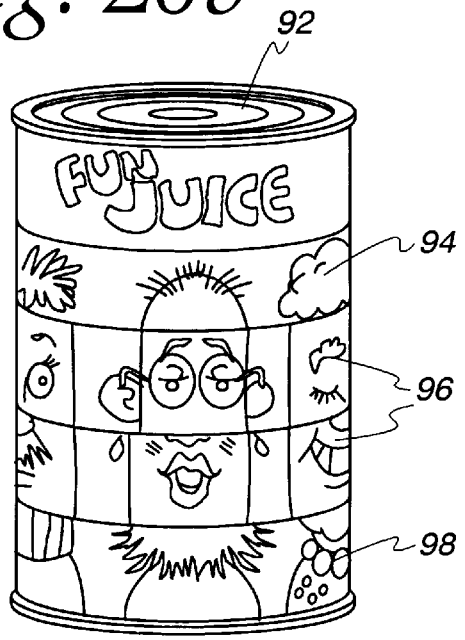

Still another variation involves dividing a label 90 on a cylindrical container 92 into two or more sections 94, 96, 98 and printing the face, body, or similar designs of more than one character on the sections (FIG. 20). By twisting the sections of the label around the axis of the cylindrical consumer product, a novelty effect is achieved by creating different face or body combinations from the artwork.

In yet another embodiment of this invention, all or a portion of the label or wrapper can be prepared from heat-responsive materials that curl, for example, in the presence of heat. In one aspect of this embodiment, a fish or other character or image can be printed onto the back of a light cellulose paper (available from a variety of paper supply houses) or thin film, such as cellophane. The figure is removable by cutting, tearing or via perforations in the label. The properties of the cellulose or film are such that the material bends or curls when placed on the palm of an outstretched hand. The degree to which the figure moves, flips, turns over or wiggles can be humorously interpreted as predicting the future of the person holding the figure.

Lenticular lenses are known as novelty and advertising devices used in rings, packaging, such raised areas on the covers of videos, books or compact discs, and toys to create the illusion of animation, motion or three dimensional imaging. Other forms of creating an animated image on a bottle or a can can be found in U.S. Pat. No. 5,525,383 to Witkowski. Lenticular lenses allow the effect of motion to be seen without the need to turn a secondary sleeve and they have wide appeal. However, lenticular lenses have generally been manufactured with a relatively stiff or semi-rigid material and therefore are impractical for use as a label or wrapper substrate since many labels or wrappers conform to the configuration of the consumer packaging. Lenticular lenses as a premium in this invention can include plastic lenses laminated to a printed image. The channels of the lens permit an individual to see a corresponding group of images or a "channel" of images depending upon the angle of viewing. There can be two or more channels that create the illusion of motion, transformation or three dimension with a singular lenticular lens. In the present invention, the flexible lenticular lens material includes a vinyl or polypropylene produced preferably via extrusion and laminated to a printed paper base. The flexible material can then be cut into label stacks and applied to consumer packaging using conventional label or wrapper equipment with minimal changes to the packaging process.

In another aspect of this invention, substrates can be used as labels or wrappers where the substrate is readily dissolvable in the present of a solvent, such as water. On example is DISSOLVO paper (available from welding trade suppliers) that has been used for determining the effectiveness of welds for pipefitters, for novelty purposes or used as a means to destroy confidential information. By incorporating this type of substrate into wrappers and labels, a premium can be prepared where images, such as pictures of animal, can disappear when the picture is removed from the label and placed in a glass of water. For example a series of "endangered species" animal pictures could be incorporated onto a label or wrapper. Alternatively, the paper can be used to create disappearing-type magic tricks for children that are deliverable on a wrapper or label.

Three-dimensional pictures can also be incorporated into labels or wrappers as well as a variety of optical illusions. Pictures involving multiple colors that can be unscrambled when viewed through a filtering lens, supplied separately or together with the consumer product, are provided to descramble the image. These novelty items can be printed on one or more surfaces using conventional inks and removed for play or enjoyment.

Figure 21:
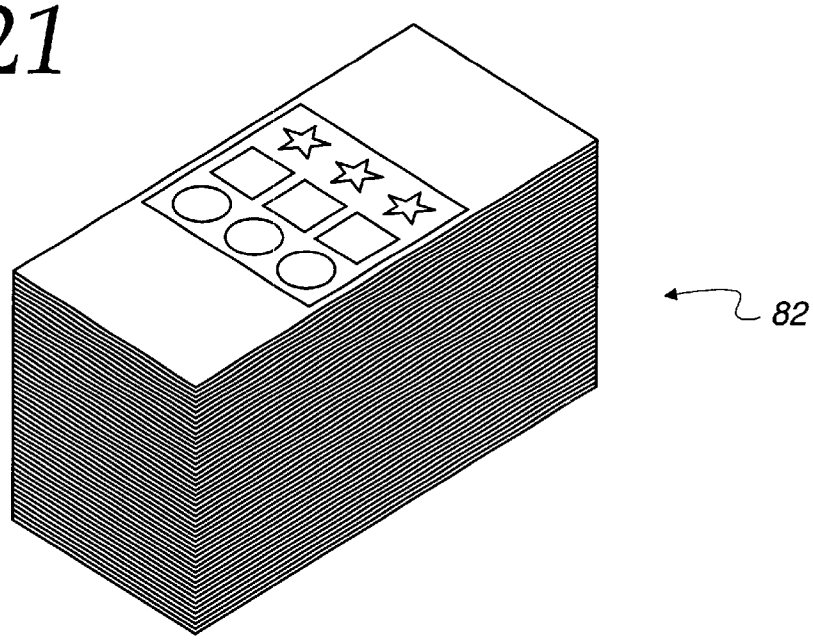
FIG. 21 is a perspective view of a stack of labels.

This invention also relates to methods for making the premiums of this invention. Importantly, the labels or wrappers are preferably substantially uniform in thickness over the length of the label or wrapper to facilitate automated application of the label or wrapper to the consumer item. In one example, FIG. 21 is a perspective view of a stack of labels 82 that incorporate the sticker premium of this invention. The stack of labels 82 is provided in a shakable form for a magazine or tray suitable for loading onto machinery capable of applying the labels to a container or package. Alternatively the labels 82 can be provided on a roll or in folded strips. In the embodiment of FIG. 21, the collectible sticker premium is provided on one face of each label; either the back or the front face. The label is prepared from a first layer and a second layer. Importantly, the stickers are integral with one of the label layers and do not add substantial thickness to the label. This permits the labeling, with the sticker premium, to be added to the consumer packaging without substantial reconfiguration, manipulation of existing packaging and labeling equipment. That is, the labeling machinery does not have to be substantially modified to accommodate overall increased label thickness. Therefore, the premiums can be added to a variety of labels without added expense or time in the product packaging process.

Essentially uniform thickness is important to the automated labeling process. A uniform thickness assures that the application equipment, for example, in the form of a magazine or tray will not be hampered by stacks of uneven labels that bulge or stick together because of addition of a sticker to the label. The stack of labels 82 illustrates the overall uniform thickness of the individual labels.

In another method of this invention, a method is provided for printing a tattoo or other transfer onto a wrapper or label. Standard flexographic printing is inefficient for tattoo label production because the narrowness of the flexographic presses render them inefficient for label printing, and particularly when high quality advertising graphics are required on a face of the labels for products such as canned soup or pasta that often includes food photography. Flexography is generally considered a substandard alternative for these types of graphics although a traditionally preferred medium for creating water soluble tattoos. Flexographic presses are also generally web or roll fed, while a lot of label printing is printed in sheet form and therefore flexographic printing is not always compatible with soup or pasta can and bottle labeling. Gravure printing can also be used to apply tattoo on labels; however, gravure plates and costs associated with printing by this method are high and the product of tattoos printed by this method can be poor since the gravure method deposes too much ink and results in blotchy or blurred tattoos that may not transfer well to the skin. Letter press printing achieves the same blotchy or blurred tattoos and is highly inefficient for printing anything but a small quantity of tattoos in a limited combination of colors. Tattoos that are not well prepared and that do not transfer well are not useful premiums since they ultimately can result in the disappointment of the child by the premium.

Figure 22:
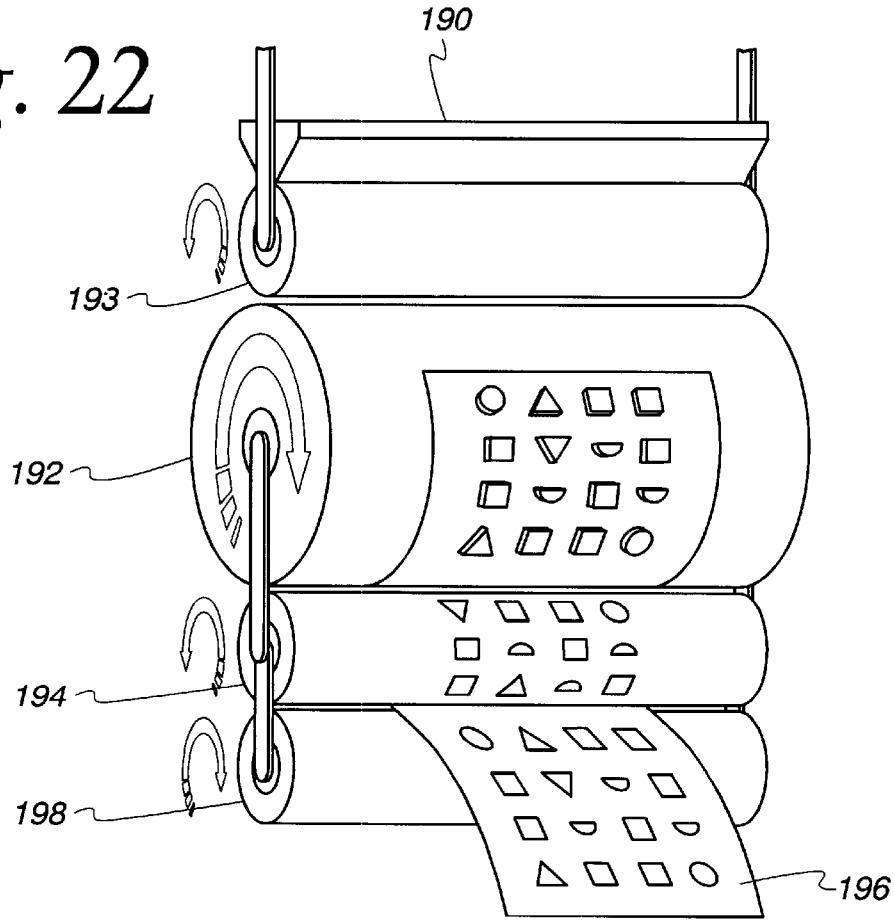
FIG. 22 illustrates a preferred method for printing a tattoo on a wrapper or label.

The present invention provides a process (FIG. 22) to create the tattoo portion of a label or wrapper where a standard offset press is used to print water soluble inks are transferred to rubber or photopolymer plates (such as CYREL plates, available from many flexographic plate manufacturers) via a rubber blanket the plates then transfer the ink to a second set of one or more rollers or blankets essentially offsetting the flexographic image that is then transferred to the paper through one or more blankets. Here ink is added in an ink well 190 that transfers the ink to a plate roller 192 via an ink roller or blanket 193 that in turn can transfer the inked image to an offset transfer blanket 194. The offset transfer blanket 194 then transfers the image to the sheet 196 using a roller 198 to feed the paper.

The benefit of this method for producing labels or wrappers with tattoos is that the same press can be used to print both sides of the label by two different methods, (standard offset and "flexographic offset") and it is not necessary to rebuild the press to accommodate the new direct flexographic process because the new method for producing the tattoos relies on a combination of raised plate printing and offset printing resulting in a superior image with water soluble inks.

Because the water soluble inks do not have the same color or drying properties as conventional inks, the method is a great improvement over other methods of printing water soluble tattoos. The precise amount of ink can be transferred to the paper in a manner that can most effectively simulate traditional process printing. The method also allows a superior reproduction to four color process printing with greater clarity and a tighter dot pattern to produce a fine reproduction of artwork not previously available using other printing methods employing water soluble inks for tattoos.

The method disclosed here is less time consuming and less expensive that direct printing with photopolymer plates on an offset press. Moreover, the paper feed or flow does not have to be reconfigured for the two processes. These adjustments can be both time consuming and expensive since the press must be refitted to accommodate the direct flexographic plates that stamp the ink directly onto paper.

A further benefit of offset printing tattoos with a photopolymer printing plate is that the plates and the offset image on a rubber roller causes the plates to last longer and provide a clearer image for a longer time because they are coming in contact with a soft surface (i.e., a roller) instead of a hard surface (paper). This delivers an image that is less likely to blur due to the fluid nature of the inks having direct contact with the paper from the plates, particularly when the inks have been liquified after the press has heated up on a print run of long duration.

All references and publications cited herein are expressly incorporated by reference into this disclosure. Particular embodiments of this invention have been discussed in detail and reference has been made to possible variations within the scope of this invention. It will be appreciated by those skilled in the art that while the invention has been described above in connection with particular embodiments, the invention is not necessarily so limited and that numerous other embodiments, uses, modifications and departures from the embodiments, examples and uses may be made without departing from the inventive scope of this application which is limited only by the spirit of this disclosure and by the claims as provided below.

What is claimed is:

1. A flexible label for consumer or commercial products capable of application to flat, shaped or curved surfaces, comprising:

a first layer having a front face, visible to the consumer, identifying the consumer product;

a second layer, separate from the first layer, having a back face, wherein the first layer and the second layer are formed of substantially the same material in grade and weight and are coextensive with one another to provide a substantially uniform thickness; and at least one removable sticker integrally formed in one of the first and second layers, wherein the removable sticker is defined by a peel guideline contained within the layer in which the sticker is formed.

2. The flexible label of claim 1, wherein the at least one removable sticker comprises a plurality of collectible stamps.

3. The flexible label of claim 1, wherein the removable sticker is located in the second layer of the label.

4. The flexible label of claim 1, wherein the consumer or commercial product includes a can, canister, jar or bottle to which the label is applied.

5. The flexible label of claim 1 that is formed as a pouch, a cylinder or a tube.

6. The flexible label of claim 1, wherein the flexible label comprises a stack, roll or folded stack of labels.

7. The flexible label of claim 1 wherein the area occupied by the sticker is at least one-fourth of the area of the label.

8. The flexible label of claim 1, wherein said consumer or commercial product includes a food or beverage packaged to receive said label.

9. The flexible label of claim 1, wherein said consumer or commercial product includes a personal care product packaged to receive said label.

10. The flexible label of claim 1, wherein said consumer or commercial product includes an audiovisual product or computer disks packaged to receive said label.

11. The flexible label of claim 1, wherein the label is prepared from a material comprising paper.

12. The flexible label of claim 1, wherein the label is prepared from a printable polymeric material.

13. The flexible label of claim 1, further comprising a third layer affixed to the back face of the second layer, wherein the first, second and third layers are coextensive with one another such that the label has a substantially uniform thickness.

14. A flexible label for consumer or commercial products capable of application to flat, shaped or curved surfaces, comprising:

a first layer having a front face, visible to the consumer, identifying the consumer product;

a second layer, separate from the first layer, having a back face, wherein the first layer and the second layer are formed of substantially the same material in grade and weight and are coextensive with one another to provide a substantially uniform thickness; and two or more removable stickers integrally formed in one of the first or second layers, wherein the removable stickers are defined by peel guidelines contained within the layer in which the stickers are formed.

15. A flexible label for consumer or commercial products capable of application to flat, shaped or curved surfaces, comprising:

a first layer having a front face, visible to the consumer, identifying the consumer product;

a second layer, separate from the first layer, having a back face, wherein the first layer and the second layer are formed of substantially the same material in grade and weight and are coextensive with one another to provide a substantially uniform thickness; and at least one removable sticker integrally formed in one of the first and second layers, wherein the removable sticker is defined by a peel guideline contained within the layer in which the sticker is formed;

wherein the back face of the label is zoned to provide an area that affixes the label to the consumer product.

* * * * *